US010336969B2

(12) United States Patent
Foster et al.

(10) Patent No.: US 10,336,969 B2
(45) **Date of Patent: *Jul. 2, 2019**

(54) PYRITHIONE PRESERVATIVE SYSTEM IN SOLID RINSE AID PRODUCTS

(71) Applicant: Ecolab USA Inc., Saint Paul, MN (US)

(72) Inventors: Tobias Foster, Cologne (DE); Andrew M. Jensen, Saint Paul, MN (US); Katherine Molinaro, Saint Paul, MN (US); Nathan D. Peitersen, Saint Paul, MN (US); Elaine Black, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/108,336

(22) Filed: Aug. 22, 2018

(65) Prior Publication Data

US 2018/0355286 A1 Dec. 13, 2018

Related U.S. Application Data

(63) Continuation of application No. 15/241,288, filed on Aug. 19, 2016, now Pat. No. 10,081,781.

(60) Provisional application No. 62/208,343, filed on Aug. 21, 2015.

(51) Int. Cl.

| | |
|---|---|
| ***C11D 1/825*** | (2006.01) |
| ***C11D 3/34*** | (2006.01) |
| ***C11D 3/32*** | (2006.01) |
| ***C11D 3/48*** | (2006.01) |
| ***C11D 3/04*** | (2006.01) |
| ***C11D 3/06*** | (2006.01) |
| ***C11D 3/10*** | (2006.01) |
| ***C11D 3/20*** | (2006.01) |
| ***C11D 3/37*** | (2006.01) |
| ***C11D 17/00*** | (2006.01) |

(52) U.S. Cl.

CPC ..... *C11D 3/349* (2013.01); *C11D 3/046* (2013.01); *C11D 3/06* (2013.01); *C11D 3/10* (2013.01); *C11D 3/2075* (2013.01); *C11D 3/323* (2013.01); *C11D 3/3418* (2013.01); *C11D 3/3707* (2013.01); *C11D 3/48* (2013.01); *C11D 17/0047* (2013.01); *C11D 17/0052* (2013.01); *C11D 17/0073* (2013.01)

(58) Field of Classification Search

CPC ..... C11D 1/825

See application file for complete search history.

(56) References Cited

U.S. PATENT DOCUMENTS

| | | | | |
|---|---|---|---|---|
| 3,489,686 | A | 1/1970 | Parran, Jr. | |
| 3,928,605 | A | 12/1975 | Curry | |
| 4,624,713 | A | 11/1986 | Morganson | |
| 5,358,653 | A | 10/1994 | Gladfelter et al. | |
| 5,876,514 | A | 3/1999 | Rolando et al. | |
| 6,294,186 | B1 | 9/2001 | Beerse et al. | |
| 6,294,515 | B1 | 9/2001 | Baum | |
| 6,432,906 | B1 | 8/2002 | Carlson et al. | |
| 6,451,333 | B1 | 9/2002 | Beerse et al. | |
| 6,475,501 | B1 | 11/2002 | Kelly et al. | |
| 6,630,440 | B1 | 10/2003 | Song et al. | |
| 8,957,011 | B2 | 2/2015 | Kieffer et al. | |
| 9,011,610 | B2 | 4/2015 | Kieffer | |
| 2003/0195134 | A1 | 10/2003 | Vandijk et al. | |
| 2005/0101516 | A1* | 5/2005 | Kieffer | C11D 1/8255 510/514 |
| 2009/0203569 | A1 | 8/2009 | Kieffer et al. | |
| 2009/0232873 | A1 | 9/2009 | Glenn, Jr. | |
| 2010/0179083 | A1* | 7/2010 | Glenn, Jr. | A61K 8/02 510/120 |
| 2012/0220516 | A1* | 8/2012 | Smith | A61K 8/0216 510/390 |
| 2012/0231992 | A1 | 9/2012 | Kieffer | |
| 2013/0130358 | A1 | 5/2013 | Davanzo | |
| 2013/0225474 | A1 | 8/2013 | Kieffer | |
| 2013/0345111 | A1* | 12/2013 | Kieffer | C11D 1/722 510/513 |
| 2014/0121151 | A1 | 5/2014 | Kieffer | |
| 2014/0335041 | A1* | 11/2014 | Peffly | A61K 8/89 424/70.121 |
| 2016/0060579 | A1 | 3/2016 | Silvernail | |

(Continued)

FOREIGN PATENT DOCUMENTS

| | | | |
|---|---|---|---|
| DE | 1813660 | A1 | 10/1970 |
| DE | 1617179 | A1 | 2/1971 |
| GB | 957458 | | 5/1964 |

(Continued)

OTHER PUBLICATIONS

BASF, Technical Bulletin, Plurafac SLF-18B45 Low-Foaming Alcohol Alkoxylate, (2002), 3 pages. Jan. 1, 2002.

Fenn, Robert J., et al., "The Stability of 2-pyridinethiol-1-oxide, sodium salt, as a function of pH", J. Soc. Cosmet. Chem, (1982), vol. 33, pp. 243-248. Aug. 1, 1982.

Bond, Andrew D., et al., "Solid-state study of cyclic thiohydroxamic acids: 1-hydroxy-2 (1H)-pyridinethione and 3-hydroxy-4-methyl-2 (3H)-thiazolethione", Journal of Physical Organic Chemistry, (2000), vol. 13, pp. 395-404. Apr. 3, 2000.

(Continued)

*Primary Examiner* — Charles I Boyer

(74) *Attorney, Agent, or Firm* — McKee, Voorhees & Sease, PLC

(57) ABSTRACT

Solid rinse aid compositions and methods of making and using the same are disclosed. Solid rinse aid compositions include in a single concentrate composition a pyrithione preservative system to replace conventional preservatives in the isothiazolinone family, such as chloromethylisothiazolinone. Beneficially, the pyrithione preservative systems eliminate the need for any personal protective equipment to handle the solid rinse aid compositions. Methods of making and use using the rinse aids are also disclosed.

22 Claims, 5 Drawing Sheets

(56) References Cited

U.S. PATENT DOCUMENTS

| | | | |
|---|---|---|---|
| 2016/0340614 | A1 | 11/2016 | Kieffer |
| 2017/0107463 | A1 | 4/2017 | Sun |

FOREIGN PATENT DOCUMENTS

| | | | |
|---|---|---|---|
| GB | 1111708 | A | 5/1968 |
| GB | 1341331 | A | 12/1973 |
| WO | 2006067439 | A1 | 6/2006 |
| WO | 2011112674 | A2 | 9/2011 |
| WO | 2015030836 | A1 | 3/2015 |
| WO | 2016033563 | A1 | 3/2016 |

OTHER PUBLICATIONS

Ecolab USA Inc. PCT/US2016/047843, filed Aug. 19, 2016, "The International Search Report and the Written Opinion of the International Searching Authority, or the Declaration" 13 pages, dated Nov. 28, 2016.

Ecolab USA Inc., PCT/US2016/047843 filed Aug. 19, 2016, 11 pages, Extended European Search Report dated Mar. 29, 2019.

* cited by examiner

PYRITHIONE PRESERVATIVE SYSTEM IN SOLID RINSE AID PRODUCTS

RELATED APPLICATIONS

This is a continuation application of U.S. Ser. No. 15/241,288, filed on Aug. 19, 2016, which claims priority to U.S. Provisional Application Ser. No. 62/208,343, filed on Aug. 21, 2015 and entitled "Pyrithione Preservative System in Solid Rinse Aid Products," all of which are herein incorporated by reference in their entirety.

FIELD OF THE INVENTION

The present invention relates to solid rinse aid compositions and methods of using the same. In particular, solid rinse aid compositions include in a single concentrate composition of a pyrithione preservative, a solid acid and/or urea, nonionic surfactants, and additional functional ingredients. In some embodiments, the solid rinse aid compositions further include a short chain alkyl benzene and/or alkyl naphthalene sulfonate. The rinse aids replace conventional preservatives in the isothiazolinone family, such as chloromethylisothiazolinone, with a pyrithione preservative system eliminating the need for any personal protective equipment (PPE) to handle the solid rinse aid compositions. Methods of using the rinse aids include using an aqueous use solution on articles including, for example, cookware, dishware, flatware, glasses, cups, hard surfaces, glass surfaces, carts, vehicle surfaces, etc., in addition to use of the rinse aids as wetting agents for use in aseptic filling procedures.

BACKGROUND OF THE INVENTION

Mechanical warewashing machines including dishwashers have been common in the institutional and household environments for many years. Such automatic warewashing machines clean dishes using two or more cycles which can include initially a wash cycle followed by a rinse cycle. Such automatic warewashing machines can also utilize other cycles, for example, a soak cycle, a pre-wash cycle, a scrape cycle, additional wash cycles, additional rinse cycles, a sanitizing cycle, and/or a drying cycle. Any of these cycles can be repeated, if desired and additional cycles can be used. Detergents and/or sanitizers are conventionally used in these warewashing applications to provide cleaning, disinfecting and/or sanitizing. In addition to detergents and sanitizers, rinse aids are also conventionally used in warewashing applications to promote drying and to prevent the formation of spots on the ware being washed. In order to reduce the formation of spotting, rinse aids have commonly been added to water to form an aqueous rinse that is sprayed on the ware after cleaning is complete.

A number of rinse aid products are currently known, each having certain advantages and disadvantages. A component of rinse aid formulations is a preservative or preservative system. A conventional preservative is isothiazolinone, including isothiazolinone blends, such as Kathon CG-ICP which is a 3:1 blend of 5-Chlor-2-methyl-4-isothiazolin-3-one and 2-Methyl-4-isothiazolin-3-one (CMIT/MIT). The preservative is included in the formulation to prevent growth of microorganisms in the intermediate dispenser sump solution of the rinse aid composition, which is created by spraying water onto a solid product to dissolve the solid (e.g. block) and generate about a use solution. Customarily, a 2-5% sump solution in water is generated and in order to achieve adequate preservation efficacy a use solution will require between 5-15 ppm active of the isothiazolinone blend in the sump. To achieve this use solution concentration the solid rinse aid product requires upwards of 220 ppm of the isothiazolinone preservative in the solid block, which may invoke the need for personal protective equipment (e.g. gloves) to handle the concentrated solid rinse aid composition. To prevent the need for safety protocols and eliminate any concerns of sensitivity upon skin contact with the concentrated solid rinse aid composition, there remains an ongoing need for alternative rinse aid compositions including the preservative systems.

Accordingly, it is an objective of the claimed invention to develop solid rinse aid compositions and methods of using the same for warewashing applications to provide desired cleaning and rinsing performance in safe and sustainable concentrated formulation.

A further object of the invention is to provide rinse aid compositions that do not require personal protective equipment to handle a concentrated solid composition.

Other objects, advantages and features of the present invention will become apparent from the following specification taken in conjunction with the accompanying drawings.

BRIEF SUMMARY OF THE INVENTION

An advantage of the invention is the replacement of conventional preservatives with a pyrithione preservative system. In particular, an advantage of the invention is the removal of isothiazolinone preservatives from rinse aid compositions and replace the concentrated compositions with a pyrithione preservative system. Beneficially, according to the embodiments of the invention, the improved rinse aid compositions are safe and sustainable, thereby eliminating the need for any personal protective equipment to handle the solid rinse aid compositions.

In an embodiment, the present invention disclose a solid rinse aid composition comprising: a pyrithione preservative; a hardening agent; one or more nonionic surfactants; and additional functional ingredients, wherein the composition is a concentrate formed into a solid and the solid concentrate is useful in preparing a stable, aqueous use solution having an acidic pH.

In a further embodiment, the present invention discloses a method of making the solid rinse aid compositions containing the pyrithione preservative systems.

In a further embodiment, the present invention discloses a method of cleaning and/or rinsing employing the solid rinse aid compositions.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
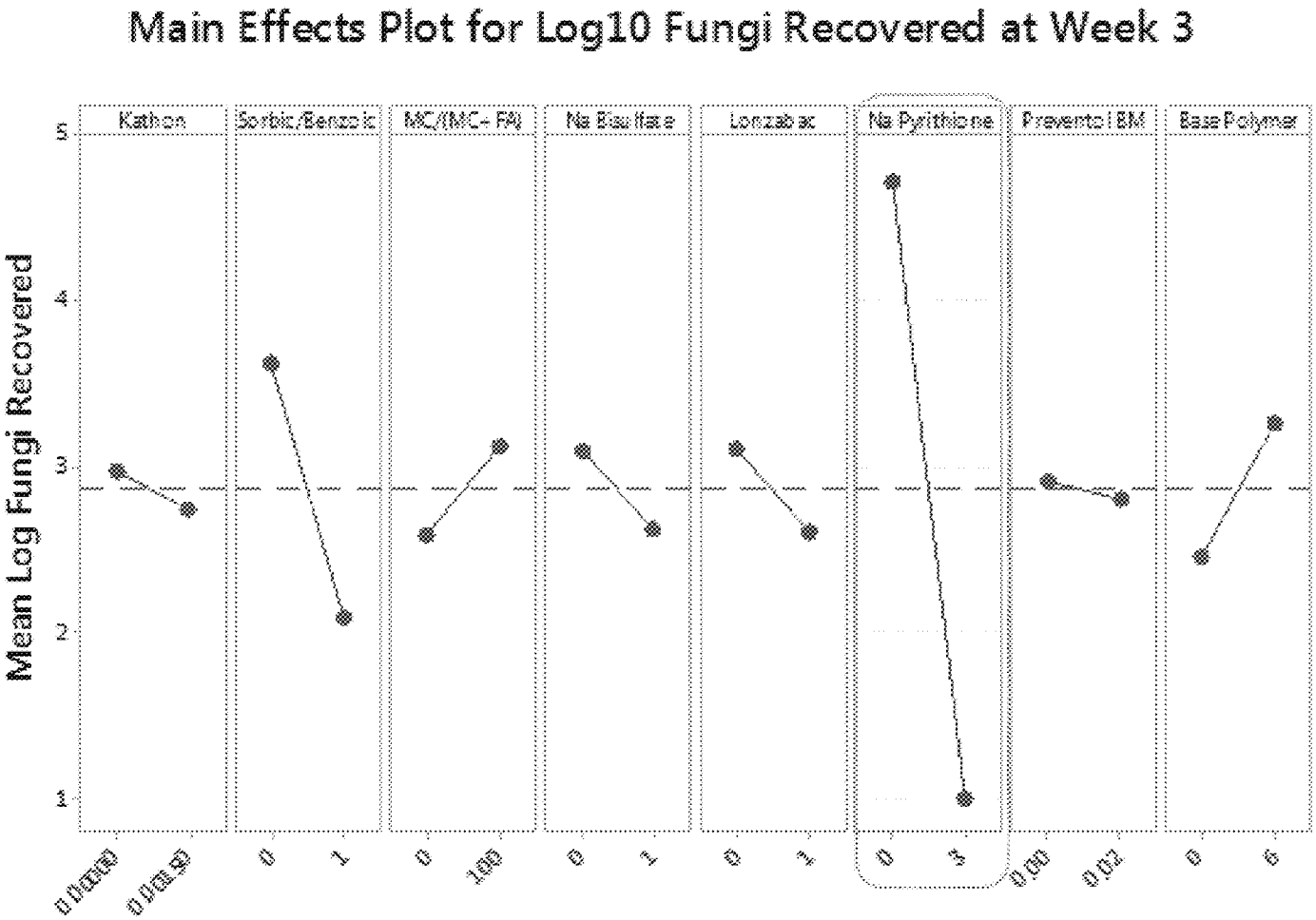
FIG. 1 shows evaluated preservative system impact on reducing fungi (mean log fungi reduction) with pyrithione providing greatest efficacy according to embodiments of the invention.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The embodiments of this invention are not limited to particular rinse aid compositions and methods of employing the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range. Throughout this disclosure, various aspects of this invention are presented in a range format. It should be understood that the description in range format is merely for convenience and brevity and should not be construed as an inflexible limitation on the scope of the invention.

Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

An "antiredeposition agent" refers to a compound that helps keep suspended in water instead of redepositing onto the object being cleaned. Antiredeposition agents are useful in the present invention to assist in reducing redepositing of the removed soil onto the surface being cleaned.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

As used herein, the term "disinfectant" refers to an agent that kills all vegetative cells including most recognized pathogenic microorganisms, using the procedure described in *A.O.A.C. Use Dilution Methods*, Official Methods of Analysis of the Association of Official Analytical Chemists, paragraph 955.14 and applicable sections, 15th Edition, 1990 (EPA Guideline 91-2). As used herein, the term "high level disinfection" or "high level disinfectant" refers to a compound or composition that kills substantially all organisms, except high levels of bacterial spores, and is effected with a chemical germicide cleared for marketing as a sterilant by the Food and Drug Administration. As used herein, the term "intermediate-level disinfection" or "intermediate level disinfectant" refers to a compound or composition that kills mycobacteria, most viruses, and bacteria with a chemical germicide registered as a tuberculocide by the Environmental Protection Agency (EPA). As used herein, the term "low-level disinfection" or "low level disinfectant" refers to a compound or composition that kills some viruses and bacteria with a chemical germicide registered as a hospital disinfectant by the EPA.

As used herein, the phrase "food processing surface" refers to a surface of a tool, a machine, equipment, a structure, a building, or the like that is employed as part of a food processing, preparation, or storage activity. Examples of food processing surfaces include surfaces of food processing or preparation equipment (e.g., slicing, canning, or transport equipment, including flumes), of food processing wares (e.g., utensils, dishware, wash ware, and bar glasses), carts, and of floors, walls, or fixtures of structures in which food processing occurs. Food processing surfaces are found and employed in food anti-spoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, autodish sanitizers, sanitizing gels, cooling towers, food processing antimicrobial garment sprays, and non-to-low-aqueous food preparation lubricants, oils, and rinse additives.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

The term "generally recognized as safe" or "GRAS," as used herein refers to components classified by the Food and Drug Administration as safe for direct human food consumption or as an ingredient based upon current good manufacturing practice conditions of use, as defined for example in 21 C.F.R. Chapter 1, § 170.38 and/or 570.38.

As used herein, the phrase "health care surface" refers to a surface of an instrument, a device, a cart, a cage, furniture, a structure, a building, or the like that is employed as part of a health care activity. Examples of health care surfaces include surfaces of medical or dental instruments, of medical or dental devices, of electronic apparatus employed for monitoring patient health, and of floors, walls, or fixtures of structures in which health care occurs. Health care surfaces are found in hospital, surgical, infirmity, birthing, mortuary, and clinical diagnosis rooms. These surfaces can be those typified as "hard surfaces" (such as walls, floors, bed-pans, etc.), or fabric surfaces, e.g., knit, woven, and non-woven surfaces (such as surgical garments, draperies, bed linens, bandages, etc.), or patient-care equipment (such as respirators, diagnostic equipment, shunts, body scopes, wheel chairs, beds, etc.), or surgical and diagnostic equipment. Health care surfaces include articles and surfaces employed in animal health care.

As used herein, the term "instrument" refers to the various medical or dental instruments or devices that can benefit from cleaning with a composition according to the present invention. As used herein, the phrases "medical instrument," "dental instrument," "medical device," "dental device," "medical equipment," or "dental equipment" refer to instruments, devices, tools, appliances, apparatus, and equipment used in medicine or dentistry. Such instruments, devices, and equipment can be cold sterilized, soaked or washed and then heat sterilized, or otherwise benefit from cleaning in a composition of the present invention. These various instruments, devices and equipment include, but are not limited to: diagnostic instruments, trays, pans, holders, racks, forceps, scissors, shears, saws (e.g. bone saws and their blades), hemostats, knives, chisels, rongeurs, files, nippers, drills, drill bits, rasps, burrs, spreaders, breakers, elevators, clamps, needle holders, carriers, clips, hooks, gouges, curettes, retractors, straightener, punches, extractors, scoops, keratomes, spatulas, expressors, trocars, dilators, cages, glassware, tubing, catheters, cannulas, plugs, stents, scopes (e.g., endoscopes, stethoscopes, and arthoscopes) and related equipment, and the like, or combinations thereof.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt-%. More preferably, the amount of phosphorus is less than 0.1 wt-%, and most preferably the amount of phosphorus is less than 0.01 wt-% in phosphorus-free compositions.

For the purpose of this patent application, successful microbial reduction is achieved when the microbial populations are reduced by at least about 50%, or by significantly more than is achieved by a wash with water. Larger reductions in microbial population provide greater levels of protection.

By the term "solid" as used to describe a composition of the present invention, it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid composition can range from that of a fused solid block which is relatively dense and hard, for example, like concrete, to a consistency characterized as being malleable and sponge-like, similar to caulking material.

As used herein, the term "soil" or "stain" refers to a non-polar oily substance which may or may not contain particulate matter such as mineral clays, sand, natural mineral matter, carbon black, graphite, kaolin, environmental dust, etc.

Differentiation of antimicrobial "-cidal" or "-static" activity, the definitions which describe the degree of efficacy, and the official laboratory protocols for measuring this efficacy are considerations for understanding the relevance of antimicrobial agents and compositions. Antimicrobial compositions can affect two kinds of microbial cell damage. The first is a lethal, irreversible action resulting in complete microbial cell destruction or incapacitation. The second type of cell damage is reversible, such that if the organism is rendered free of the agent, it can again multiply. The former is termed microbiocidal and the latter, microbistatic. A sanitizer and a disinfectant are, by definition, agents which provide antimicrobial or microbiocidal activity. In contrast, a preservative is generally described as an inhibitor or microbistatic composition As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning and/or rinsing product or substitute cleaning and/or rinsing system of generally the same degree (or at least not a significantly lesser degree) of cleanliness or with generally the same expenditure (or at least not a significantly lesser expenditure) of effort, or both.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

It should also be noted that, as used in this specification and the appended claims, the term "configured" describes a system, apparatus, or other structure that is constructed or configured to perform a particular task or adopt a particular configuration. The term "configured" can be used interchangeably with other similar phrases such as arranged and configured, constructed and arranged, adapted and configured, adapted, constructed, manufactured and arranged, and the like.

Solid Rinse Aid Compositions

The solid rinse aid compositions according to the present invention provided enhanced sustainability and safety through the use of a pyrithione preservative system to replace conventional isothiazolinone preservatives. Beneficially, the solid rinse aid compositions eliminate the need for protective equipment to handle the solid, concentrated compositions. The preservative system for the solid rinse aid compositions according to the invention provide unexpected benefits in product stability, in both acidic and neutral compositions, despite the formulation challenges for various solid product formulations. The preservative systems maintain efficacy in preserving the intermediate diluted solution of the rinse aid composition which requires preservation.

In a further aspect, the concentrated solid rinse aid compositions provide shelf-stability of least one year at room temperature (22° C.). The shelf-stability of the concentrated solid rinse aid compositions provides maintained antimicrobial efficacy of the rinse aid compositions after storage of at least one year at room temperature. Retained antimicrobial activity is measured by performance efficacy in preserving the intermediate diluted solution of the rinse aid composition instead of the concentration of the pyrithione preservative system. As one skilled in the art will ascertain, the pyrithione preservative system may degrade into antimicrobial active compounds different from the pyrithione preservative system, such as for example, 2,2'-Dithiobis(pyridine-N-oxide). In an aspect, the concentrated solid rinse aid compositions provide shelf-stability of least one year at room temperature as measured by a maintained performance efficacy of at least 75%, 80%, 85%, 90%, 95% or 100% after one year or greater in preserving the intermediate diluted solution of the rinse aid composition.

In a still further aspect, the concentrated solid rinse aid compositions provide at least substantially similar preservation performance in a sump solution to conventional preservatives, including isothiazolinones. In preferred aspects, the concentrated solid rinse aid compositions provide improved preservation performance in comparison to conventional preservatives, including isothiazolinones, as measured by antimicrobial efficacy of the rinse aid in an intermediate diluted sump solution of the rinse aid composition. In an aspect, the concentrated solid rinse aid compositions employing pyrithione preservatives retain preservative efficacy in the sump solution for at least 2 weeks, or at least 4 weeks, or at least 8 weeks. In further aspects, the concentrated solid rinse aid compositions employing pyrithione preservatives retain preservative efficacy in the sump solution for at least 3 months.

In further aspects, the concentrated solid rinse aid composition has shelf-stability as a solid for at least about 1 year.

In an aspect, an exemplary embodiment of the concentrated solid rinse aid composition having an improved safety and sustainability preservative system comprises: a pyrithione preservative system, a solid acid, a short-chain alkylbenzene or alkyl naphthalene sulfonate, one or more rinse aid surfactants, and other optional additional functional ingredients. In an aspect, the concentrated solid rinse aid composition include the exemplary ranges shown in Table 1.

TABLE 1

| Material | First Exemplary Range wt-% | Second Exemplary Range wt-% | Third Exemplary Range wt-% |
|---|---|---|---|
| Pyrithione Preservative System | 0.1-20 | 0.1-10 | 0.5-5 |
| Solid Acid | 5-40 | 7.5-27.5 | 10-25 |
| Short-Chain Alkylbenzene and/or Alkyl Naphthalene Sulfonate | 40-90 | 45-85 | 50-80 |
| Rinse Aid Surfactants (defoaming and wetting surfactants) | 0.1-75 | 1-50 | 5-30 |
| Additional Functional Ingredients | 0-50 | 1-50 | 2-50 |

In an aspect, an exemplary embodiment of the concentrated solid rinse aid composition having an improved safety and sustainability preservative system comprises: a pyrithione preservative system, a urea, a solid acid, one or more rinse aid surfactants, and other optional additional functional ingredients. In an aspect, the concentrated solid rinse aid composition include the exemplary ranges shown in Table 2.

TABLE 2

| Material | First Exemplary Range wt-% | Second Exemplary Range wt-% | Third Exemplary Range wt-% |
|---|---|---|---|
| Pyrithione Preservative System | 0.1-20 | 0.1-10 | 0.5-5 |
| Urea | 1-50 | 2.5-50 | 5-40 |
| Solid Acid | 1-40 | 1-25 | 1-15 |
| Rinse Aid Surfactants (defoaming and wetting surfactants) | 0.1-75 | 1-50 | 5-50 |
| Additional Functional Ingredients | 0-50 | 1-50 | 10-50 |

Additional exemplary embodiments of the concentrated solid rinse aid compositions employing pyrithione preservatives include the exemplary ranges shown in the following Tables 3-9.

TABLE 3

| Material | Exemplary Range (wt-%) |
|---|---|
| Urea (e.g. prilled) | 25-45 |
| C10-12 Alcohol 21 EO | 10-30 |
| Reverse EO PO Block Copolymer | 20-50 |
| Acrylic acid sodium salt polymer | 5-10 |
| Sodium Pyrithione (40%) | 0.5-5 |
| Citric acid or a monovalent salt (e.g. Monosodium Citrate) | 5-25 |
| Water | 0-5 |

TABLE 4

| Material | Exemplary Range (wt-%) |
|---|---|
| Sodium Xylene Sulfonate, 96% | 50-80 |
| Citric Acid anhydrous | 5-25 |
| C10-12 Alcohol 21 EO | 1-5 |
| Reverse EO PO Block Copolymer | 1-5 |
| Butoxy Capped Alcohol Ethoxylate | 1-10 |
| C12-16 Alcohol 7PO 5EO | 1-10 |
| Na4 HEDP 85% (~59% as acid) | 1-5 |
| Acrylic acid sodium salt polymer | 5-10 |
| Pyrithione Preservative System | 0.5-2 |

TABLE 5

| Material | Exemplary Range (wt-%) |
|---|---|
| C10-12 Alcohol 21 EO | 1-10 |
| Reverse EO PO block copolymer | 20-50 |
| Butoxy Capped Alcohol Ethoxylate | 10-20 |
| C12-16 Alcohol 7PO 5EO | 1-10 |
| Monosodium citrate | 10-20 |
| Acrylic acid sodium salt polymer | 5-10 |
| Urea prilled | 25-45 |
| Water | 0-5 |
| Pyrithione Preservative System | 0.5-2 |

TABLE 6

| Material | Exemplary Range (wt-%) |
|---|---|
| C10-16 Alcohol Ethoxylate | 1-20 |
| Reverse EO PO block copolymer | 1-40 |
| Fatty Alcohol with EO PO Adducts | 0-10 |
| Butoxy Capped Alcohol Ethoxylate | 0-5 |
| Monosodium citrate and/or citric acid | 5-15 |
| Acrylic acid sodium salt polymer | 5-10 |
| Urea prilled | 25-45 |
| Water | 0-5 |
| Pyrithione Preservative System | 0.5-5 |

TABLE 7

| Material | Exemplary Range (wt-%) |
|---|---|
| C10-16 Alcohol EO | 1-8 |
| Reverse EO PO block copolymer | 20-30 |
| Butoxy Capped Alcohol Ethoxylate | 10-20 |
| Fatty Alcohol with EO PO Adducts | 5-10 |
| Monosodium citrate | 5-10 |
| Acrylic acid sodium salt polymer | 0-5 |
| Urea prilled | 25-40 |
| Water | 0-10 |
| Pyrithione Preservative System | 1-7 |

TABLE 8A

| Material | Exemplary Range (wt-%) |
|---|---|
| C10-16 Alcohol EO | 1-8 |
| Reverse EO PO block copolymer | 1-5 |
| Butoxy Capped Alcohol Ethoxylate | 1-5 |
| Fatty Alcohol with EO PO Adducts | 5-10 |
| Citric acid | 0.5-2 |
| Acrylic acid sodium salt polymer | 5-10 |
| Water | 1-10 |
| Pyrithione Preservative System | 1-5 |
| Sodium xylene Sulfonate | 50-75 |
| Na4 HEDP | 1-5 |

TABLE 8B

| Material | Exemplary Range (wt-%) | Exemplary Range (wt-%) |
|---|---|---|
| Acrylic acid sodium salt polymer (Sodium polyacrylate 445ND) | 5-25 | 5-15 |
| Pyrithione Preservative System | 1-2.5 | 1-2 |
| Sodium xylene Sulfonate | 15-70 | 20-60 |
| Sodium acetate | 0-40 | 0-20 |
| Sodium bicarbonate | 0-40 | 0-20 |
| Dense ash | 0-20 | 0-10 |
| Acid violet | 0-0.1 | 0-0.1 |
| Dehypon Wet | 0-10 | 0-5 |
| Plurafac SLF 180 | 0-10 | 0-5 |
| Enzymes (e.g. savinase, esperase) | 0-30 | 5-15 |

TABLE 9

| Material | Exemplary Ranges (wt-%) | | | | | | | | |
|---|---|---|---|---|---|---|---|---|---|
| Urea | 25-45 | 25-45 | 25-45 | 25-45 | 25-45 | 25-45 | 25-45 | 25-45 | 25-45 |
| Alcohol Ethoxylate | 10-20 | 10-20 | 10-20 | 10-20 | 10-20 | 10-20 | 10-20 | 10-20 | 10-20 |
| Reverse EO PO Block Copolymer | 30-45 | 30-45 | 30-45 | 30-45 | 30-45 | 30-45 | 30-45 | 30-45 | 30-45 |
| Water | 1-3 | 1-3 | 1-3 | 1-3 | 1-3 | 1-3 | 1-3 | 1-3 | 1-3 |
| 40% pyrithione | 2.5-4 | 2.5-4 | 2.5-4 | 2.5-4 | 2.5-4 | 2.5-4 | 2.5-4 | 2.5-4 | 2.5-4 |
| Acrylic acid sodium salt polymer | 0.00 | 5-10 | 0.00 | 5-10 | 5-10 | 5-10 | 5-10 | 5-10 | 5-10 |
| monosodium citrate | 0.00 | 0.00 | 5-20 | 0.00 | 0.00 | 0.00 | 5-20 | 5-20 | 5-20 |
| benzoic acid | 0.00 | 0.00 | 0-5 | 0.00 | 0.00 | 0.00 | 0-5 | 0.00 | 0.00 |
| sorbic acid | 0.00 | 0.00 | 0-5 | 0.00 | 0.00 | 0.00 | 0-5 | 0.00 | 0.00 |

Embodiments of the Solid Concentrate Rinse Aid Compositions

According to the invention, the concentrated, solid compositions set forth in Tables 1 and 2 have neutral to acidic pH upon dilution into a sump solution where preservation is provided according to the invention. According to aspects of the invention, the diluted sump solutions may have acidic or neutral pH depending upon a particular application of use thereof of the further dilution to a use solution of the composition. In one aspect, the pH of the sump solution of the compositions is between about 0 to about 7, between about 1 to about 6, between about 2 to about 6, between about 2.5 to about 5.5, or below about 6, or below about 5.7. Without being limited to a particular mechanism of action the preserved use solution of the solid composition performs best at an acidic pH, in some embodiments at a pH of about 6 or about 5.7 or lowe due to the pKa of the preservation system at about 4.7.

In an aspect, a sump solution is from a 1% to 20% of the solid rinse aid composition, from about 2% to a 20% of the solid rinse aid composition, or preferably from about 2% to a 15% of the solid rinse aid composition. In an aspect, a desired range of the pyrithione preservative system in the sump solution is from about 100 ppm to about 1000 ppm, from about 100 ppm to about 500 ppm, or from about 150 ppm to about 300 ppm.

In additional aspects, the compositions set forth in the Tables above are suitable for dilution and use at temperatures up to about 100° F., up to about 110° F., up to about 120° F., up to about 185° F., at temperatures from about 100° F. to about 140° F., at temperatures above about 140° F., and at temperatures up to or above 185° F. Without limiting the scope of invention, the numeric ranges are inclusive of the numbers defining the range and include each integer within the defined range.

The rinse aid compositions are preferably formulated as concentrate compositions which are diluted to form a sump solution for preservation of an intermediate solution which may be further diluted to generate a use compositions for an application of use as described herein. In general, a concentrate refers to a composition that is intended to be diluted with water to provide sump solution and thereafter a use solution that contacts an object to provide the desired cleaning, rinsing, or the like. The rinse aid composition that contacts the articles to be washed can be referred to as a concentrate or a use composition (or use solution) dependent upon the formulation employed in methods according to the invention.

A sump solution and thereafter a use solution may be prepared from the concentrate by diluting the concentrate with water at a dilution ratio that provides a sump solution and optionally thereafter a use solution having desired rinsing properties. The water that is used to dilute the concentrate can be referred to as water of dilution or a diluent, and can vary from one location to another. The typical dilution factor is between approximately 1 and approximately 25,000, or from approximately 1 and approximately 20,000, which will depend on factors including water hardness, the surfaces to be treated and the like. In an embodiment, the concentrate is diluted at a ratio of between about 1:10,000 and about 1:20,000 concentrate to water to generate a sump solution. A sump solution is generally further diluted in the range such as from about 0.5 mL to about 10 mL sump solution per 3000 mL rinse water to form a use solution for application to a surface. Without limiting the scope of invention, the numeric ranges are inclusive of the numbers defining the range and include each integer within the defined range.

Pyrithione Preservative System

According to the invention, the solid rinse aid composition includes an effective amount of a pyrithione preservative. In an aspect, the pyrithione preservative includes a metal salt of pyrithione (e.g. zinc), further including alkali metal salts of pyrithione (e.g. sodium, potassium, lithium), an amine salt of pyrithione or an acid form of pyrithione. Suitable amine salts of pyrithione include for example, ammonium pyrithione or monoethanolamine pyrithione.

In a preferred aspect, the pyrithione preservative is Sodium Pyrithione, which may also be referred to by trade names Sodium Omadine and Sodium Pyrion, or by chemical names 1-hydroxy-2(1H)-pyridinethione, sodium salt (15922-78-8) and 2-pyridinethio-1-oxide, sodium salt (3811-73-2), sodium 2-pyridinethiol 1-oxide, sodium 1-hydroxypyridine-2-thione, and sodium 2-mercaptopyridine-N-oxide.

In an aspect, the pyrithione preservative is a metal salt of pyrithiones, including for example, polyvalent metal salts of pyrithione (also known as 1-hydroxy-2-pyridinethione; 2-pyridinethiol-1-oxide; 2-pyridinethione; 2-mercaptopyridine-N-oxide; pyridinethione; and pyridinethione-N-oxide). Suitable metal salts or complexes of pyrithiones, such as zinc, copper, bismuth, tin, cadmium, magnesium, aluminum, and zirconium may be used in the composition. Additional disclosure of polyvalent metal salts of pyrithione compounds and synthesis thereof is disclosed in U.S. Pat. Nos. 2,786,847, 2,809,971, 3,589,999, 3,590,035, and 3,773,770, each of which are herein incorporated by reference in its entirety. In an aspect, the zinc salt (zinc pyrithione or zinc omadine) is a suitable pyrithione preservative.

In in some embodiments the pyrithione preservative system for the solid rinse aid composition is most stable in acid formulations of the solid rinse aid compositions. Pyrithione preservatives, namely sodium pyrithione has a pKa of about 4.6 to about 4.7, and as the pKa is approached the preservative may be more sensitive to photodegradation and oxidative degradation.

In an embodiment, the pyrithione preservative system is a GRAS preservative system for acidification of the solid rinse aid composition. In at least some embodiments, the solid rinse aid compositions generates an acidic pH in a sump solution. In some embodiments the sump pH is from 0 to 7, as high as 6.7, from 1 to 6, from 2 to 6, or from 2.5 to about 5.5. Typically, the solid rinse aid is formulated to include components that are suitable for use in food service industries, e.g., GRAS ingredients, a partial listing is available at 21 CFR 184. In some embodiments, the solid rinse aid is formulated to include only GRAS ingredients. In other embodiments, the solid rinse aid is formulated to include GRAS and biodegradable ingredients.

In other embodiments a coated or encapsulated pyrithione preservative system may be employed.

The preservative component is present in the solid rinse aid compositions of the invention in an amount of the solid rinse aid composition from about 0.05 wt-% to about 20 wt-%, from about 0.1 wt-% to about 10 wt-%, from about 0.5 wt-% to about 10 wt-%, from about 1 wt-% to about 10 wt-%, and preferably from about 0.5 wt-% to about 5 wt-%, and still more preferably from about 0.75 wt-% to about 2 wt-%.

In additional embodiments, the solid rinse aid composition can further include additional preservatives and/or sanitizers/anti-microbial agents in addition to the pyrithione preservative system. In an aspect, the solid rinse aid compositions do not include any isothiazolinone preservatives. In an aspect, the solid rinse aid compositions do not include any additional preservatives requiring use of personal protective equipment for handling.

Solid Acids

According to the invention, the solid rinse aid compositions can include one or more solid acids as a hardening agent for the solid composition. The solid acid of the composition includes any acid which is naturally or treated to be in solid form at room temperature. The term solid here includes forms such as powdered, particulate, or granular solid forms. Acidic substances (herein referred to as "acids") include, but are not limited to, pharmaceutically acceptable organic or inorganic acids, hydroxyl-acids, amino acids, Lewis acids, mono- or di-alkali or ammonium salts of molecules containing two or more acid groups, and monomers or polymeric molecules containing at least one acid group. Examples of suitable acid groups include carboxylic, hydroxamic, amide, phosphates (e.g., mono-hydrogen phosphates and di-hydrogen phosphates), sulfates, and bi-sulfites.

In particular, the acids are organic acids with 2-18 carbon atoms, including, but not limited to, short, medium, or long chain fatty acids, hydroxyl acids, inorganic acids, amino acids, and mixtures thereof. Preferably, the acid is selected from the group consisting of lactic acid, gluconic acid, citric acid, tartaric acid, hydrochloric acid, phosphoric acid, nitric acid, sulfuric acid, maleic acid, monosodium citrate, disodium citrate, potassium citrate, monosodium tartrate, disodium tartrate, potassium tartrate, aspartic acid, carboxymethylcellulose, acrylic polymers, methacrylic polymers, and mixtures thereof. Anhydrous forms of the acids are preferred.

For example many organic acids are crystalline solids in pure form (and at room temperature), e.g. citric acid, oxalic acid, benzoic acid. Sulphamic acid in an example of an inorganic acid that is solid a room temperature. In other embodiments a coated or encapsulated acid may be employed.

The solid acid or combination of one or more solid acids is present in the solid rinse aid compositions of the invention in an amount of from about 5 wt-% to about 40 wt-%, preferably from about 7.5 wt-% to about 27.5 wt-% and more preferably from about 10 wt-% to about 25 wt-%.

Short Chain Alkyl Benzene or Alkyl Naphthalene Sulfonate

According to the invention, the solid rinse aid compositions can include a short chain alkyl benzene and/or alkyl naphthalene sulfonate. The class of short chain alkyl benzene or alkyl naphthalene sulfonates work as both a hardening agent and as a hydrotrope and TDS control active in the composition. The group includes alkyl benzene sulfonates based on toluene, xylene, and cumene, and alkyl naphthalene sulfonates. Sodium toluene sulfonate and sodium xylene sulfonate are the best known hydrotropes. These have the general formula below:

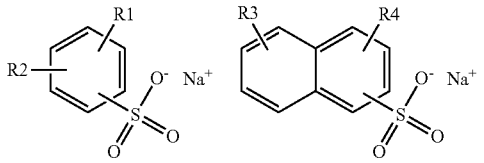

R1 = C1, C2 OR C3
R2 = C1 OR H
ALKYLBENZENE SULFONATE

R3 = C1, C2, C3 OR H
R4 = C1, C2, C3, C4 OR H
ALKYLNAPHTHALENE SULFONATE

This group includes but is not limited to sodium xylene sulfonate, sodium toluene sulfonate, sodium cumene sulfonate, potassium toluene sulfonate, ammonium xylene sulfonate, calcium xylene sulfonate, sodium alkyl naphthalene sulfonate, and sodium butylnaphthalene sulfonate. In a preferred embodiment the solidification agent is sodium xylene sulfonate (SXS).

The invention provides a solid rinse aid composition including effective amounts of one or more of a short chain alkyl benzene or alkyl naphthalene sulfonates. Surprisingly, this class of hydrotropes has been found to add to performance of the solid rinse aid as well as functioning as solidification agent. The short chain alkyl benzene or alkyl naphthalene sulfonate may also function as a builder. The solid rinse aid composition typically has a melt point greater than 110° F. and is dimensionally stable. In some embodiments, the hardening agent of a short chain alkyl benzene or alkyl naphthalene sulfonate is present in an amount of from about 40 wt-% to about 90 wt-%, preferably from about 45 wt-% to about 85 wt-% and more preferably from about 50 wt-% to about 80 wt-%.

The solid rinse aid can also in some embodiments and as enumerated hereinafter, include an additional processing aid for hardening and solidification (also referred to as hardening agents), such as polyethylene glycol, or urea, including in the amount of from about 0.1 wt-% to about 10 wt-%.

Surfactants

According to the invention, rinse aid surfactant(s) are included for rinsing efficacy in the rinsing compositions disclosed herein. The rinse aid surfactant(s) are required to provide rinse aid performance, including sheeting, spot- and film-free ware and quick drying performance in the presence of peroxycarboxylic acid and hydrogen peroxide. In further aspects, the rinse aid surfactant(s) provide antifoaming properties to overcome foam generated by agitation of machine sump solutions (e.g. such as those containing proteinaceous food soils). In some embodiments, the rinse aid surfactant(s) are stable and provide such rinse aid performance under acidic conditions and are accordingly referred to as acid-compatible.

In some embodiments, the compositions of the present invention include more than one rinse aid surfactant, and preferably include a combination of at least two rinse aid surfactants. In some embodiments a combination of surfactants is provided wherein one surfactant predominantly provides antifoaming properties, and wherein the second surfactant predominantly aids in sheeting and drying (i.e. wetting surfactant). Surfactants suitable for use with the compositions of the present invention include nonionic surfactants.

In some embodiments, the concentrated compositions of the present invention include about 0.1 wt-% to about 75 wt-% of a nonionic surfactant. In other embodiments the compositions of the present invention include about 1 wt-% to about 75 wt-% of a nonionic surfactant, from about 1 wt-% to about 50 wt-% of a nonionic surfactant, or from about 5 wt-% to about 30 wt-% of a nonionic surfactant. In addition, without being limited according to the invention, all ranges are inclusive of the numbers defining the range and include each integer within the defined range.

In some aspects the ratio of a combination of nonionic surfactants, such as a defoaming to wetting surfactant, may impact the shelf-life of the rinse aid composition according to the invention. In a further aspect, the ratio of the defoaming to wetting surfactants impacts the anti-foaming capabilities of the composition. According to the invention, in preferred aspects, the concentration of the defoaming surfactants exceeds the concentration of the wetting surfactant. In further aspects the ratio is from about 1:1 to about 100:1, preferably from about 1:1 to about 50:1. In some aspects the ratio of the defoaming surfactants to the wetting surfactants is from about 1.5:1 to about 10:1, preferably from about 2:1 to about 5:1. In addition, without being limited according to the invention, all ranges for the ratios recited are inclusive of the numbers defining the range and include each integer within the defined range of ratios.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

In an aspect, preferred nonionic surfactants for use as the defoaming surfactant include block polyoxypropylene-polyoxyethylene polymeric compounds such as alcohol-EO-PO nonionic surfactants. Exemplary alcohol-EO-PO nonionics are commercially available under the tradename Plurafac®. Without being limited to a particular theory of the invention, alcohol-EO-PO surfactants retain antifoaming properties longer than polyoxypropylene-polyoxyethylene polymeric compounds having an EOm-POn-EOm (wherein m is an integer between 1-200, and n is an integer between 1-100) type structure (such as those commercially-available under the tradename Pluronic®, manufactured by BASF Corp.) and compounds having an POm-EOn-POm (wherein m is an integer between 1-100, and n is an integer between 1-200) type structure (such as those commercially-available under the tradename Pluronic® R, also manufactured by BASF Corp.) due to the presence of the peroxycarboxylic acid and hydrogen peroxide in the formulations according to the invention.

A particularly useful group of alcohol alkoxylates are those having the general formula R-$(EO)_m$—$(PO)_n$, wherein m is an integer of about 1-20, preferably 1-10 and n is an integer of about 1-20, preferably 2-20, and wherein R is any suitable radical, including for example a straight chain alkyl group having from about 6-20 carbon atoms.

In a further aspect, preferred nonionic surfactants include capped or end blocked surfactants (wherein the terminal hydroxyl group (or groups)) is capped. In an embodiment, capped aliphatic alcohol alkoxylates include those having end caps including methyl, ethyl, propyl, butyl, benzyl and chlorine and may have a molecular weight of about 400 to about 10,000. Without being limited to a particular theory of the invention, capped nonionic surfactants provide improved stability over PO-EO-PO type or EO-PO-EO type structure nonionics (such as those commercially-available under the tradenames Pluronic® and Pluronic® R, manufactured by BASF Corp). According to the invention, the capping improves the compatibility between the nonionic surfactants and the oxidizing hydrogen peroxide and peroxycarboxylic acids when formulated into a single composition.

In a further aspect, preferred nonionic surfactants for use as the wetting surfactant include alkyl ethoxylates and/or alcohol ethoxylates. In some embodiments, the wetting agent includes one or more alcohol ethoxylate compounds that include an alkyl group that has 12 or fewer carbon atoms. For example, alcohol ethoxylate compounds for use in the rinse aids of the present invention may each independently have structure represented by the following formula: R—O—$(CH_2CH_2O)_n$—H, wherein R is a $C_1$-$C_{16}$ alkyl group and n is an integer in the range of 1 to 100. In other embodiments, R may be a ($C_8$-$C_{12}$) alkyl group, or may be a ($C_8$-$C_{10}$) alkyl group. Similarly, in some embodiments, n is an integer in the range of 1-50, or in the range of 1-30, or in the range of 1-25. In some embodiments, the one or more alcohol ethoxylate compounds are straight chain hydrophobes. An example of such an alcohol ethoxylate wetting surfactant is commercially available from Sasol under the tradename NOVEL® 1012-21 GB.

In at least some embodiments, the nonionic surfactants of the solid rinse aid composition includes at least two different alcohol ethoxylate compounds each having structure represented by Formula I. That is, the R and/or n variables of Formula I, or both, may be different in the two or more different alcohol ethoxylate compounds present in the sheeting agent. For example, the nonionic surfactants of the solid rinse aid composition in some embodiments may include a first alcohol ethoxylate compound in which R is a ($C_8$-$C_{10}$) alkyl group, and a second alcohol ethoxylate compound in which R is a ($C_{10}$-$C_{12}$) alkyl group. In at least some embodiments, the nonionic surfactants of the solid rinse aid composition does not include any alcohol ethoxylate compounds that include an alkyl group that has more than 12 carbon atoms. In some embodiments, the nonionic surfactants of the solid rinse aid composition includes only alcohol ethoxylate compounds that include an alkyl group that has 12 or fewer carbon atoms.

In some embodiments where, for example, the nonionic surfactants of the solid rinse aid composition includes at least two different alcohol ethoxylate compounds, the ratio of the different alcohol ethoxylate compounds can be varied to achieve the desired characteristics of the final composition. For example, in some embodiments including a first alcohol ethoxylate compound and a second alcohol ethoxylate compound, the ratio of weight-percent first alcohol ethoxylate compound to weight-percent second compound may be in the range of about 1:1 to about 10:1 or more. For example, in some embodiments, the nonionic surfactants of the solid rinse aid composition can include in the range of about 50% weight percent or more of the first compound, and in the range of about 50 weight percent or less of the second compound, and/or in the range of about 75 weight percent or more of the first compound, and in the range of about 25 weight percent or less of the second compound, and/or in the range of about 85 weight percent or more of the first compound, and in the range of about 15 weight percent or less of the second compound. Similarly, the range of mole ratio of the first compound to the second compound may be about 1:1 to about 10:1, and in some embodiments, in the range of about 3:1 to about 9:1.

Alkyl ethoxylate surfactants terminated with methyl, benzyl, and butyl "capping" groups are known, with the methyl and butyl capped versions being commercially available. However, the various alkyl ethoxylates can contain a significant amount of unprotected (i.e., uncapped) hydroxyl groups. Therefore, there is a preference for use of the alkyl ethoxylate surfactants to be capped to remove the reactivity of unprotected hydroxyl groups. In a further embodiment, the surfactant has only a single uncapped hydroxyl group, such as the following exemplary structures: Alkyl-(EO)m-(PO)n-POH and Alkyl-(EO)n-EOR, wherein R=alkyl (60-80%), R=H (20-40%), and wherein m is an integer in the range from 1 to 20 and n is an integer in the range from 1 to 20.

In some embodiments, the defoaming and wetting surfactants used can be chosen such that they have certain characteristics, for example, are environmentally friendly, are suitable for use in food service industries, and/or the like. For example, the particular alcohol ethoxylates used in the sheeting agent may meet environmental or food service regulatory requirements, for example, biodegradability requirements. In a preferred aspect, the nonionic surfactants employed in the rinse aid compositions are approved by the U.S. EPA under CFR 180.940 for use in food contact sanitizers. Additional nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp. Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Tetronic® compounds are tetra-flinctional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol™ manufactured by Shell Chemical Co. and Alfonic™ manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol™ manufactured by Henkel Corporation and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

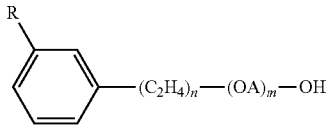

in which R is an alkyl group of 8 to 9 carbon atoms, A is an alkylene chain of 3 to 4 carbon atoms, n is an integer of 7 to 16, and m is an integer of 1 to 10.

8. The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

9. The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

10. The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n\ (C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

11. Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

12. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

13. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

14. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

15. Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_xH$, where x is in the range of from 1 to 3.

16. A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Particularly suitable surfactant packages for incorporation into the solid rinse aid compositions of the invention include those disclosed in U.S. application Ser. Nos. 15/157,021, 15/157,124 and 15/157,194 each titled Efficient Surfactant System On Plastic And All Types Of Ware, the entire disclosure of which is incorporated herein by reference. In some embodiments, the surfactant systems may include those shown in the exemplary combinations disclosed herein:

| Surfactant | | Exemplary parts by wt-ranges 1 | 2 | 3 | 4 |
|---|---|---|---|---|---|
| Surfactant A and/or | $R^1$—O—$(EO)_{x3}(PO)_{y3}$—H | 5-80 | 20-80 | 30-60 | 30-45 |
| Surfactant A2 | $R^1$—O—$(EO)_{x4}(PO)_{y4}$—H | 5-80 | 20-80 | 30-60 | 30-45 |
| Surfactant B | $R^2$—O—$(EO)_{x1}$—H | 0-80 | 0-60 | 0-50 | 0-40 |
| Surfactant C | $R^2$—O—$(EO)_{x2}$—H | 0-80 | 0-60 | 0-40 | 0-20 |
| Surfactant D | $R^7$—O—$(PO)y_5(EO)x_5(PO)y_6$ | 0-80 | 0-60 | 0-40 | 0-20 |
| Surfactant E | $R^6$—O—$(PO)y_4(EO)x_4$ ($R^6$ is $C_8$-$C_{16}$-guerbet) | 0-80 | 0-60 | 0-40 | 0-20 |

In an aspect, the surfactant system includes Surfactant A having the following formula: $R^1$—O-$(EO)_{x3}(PO)_{y3}$—H, wherein $R^1$ is a straight-chain $C_{10}$-$C_{16}$-alkyl, and wherein $x_3$=5-8, preferably 5.5-7, and wherein $y_3$=2-5, preferably 2-3.5. In an aspect, the surfactant system includes from about 5-80 parts by weight of at least one alkoxylate of the formula $R^1$—O-$(EO)_{x3}(PO)_{y3}$—H, wherein $R^1$ is a straight-chain $C_{10}$-$C_{16}$-alkyl, and wherein $x_3$=5-8, preferably 5.5-7, and wherein $y_3$=2-5, preferably 2-3.5.

In an aspect, the surfactant system includes Surfactant A2 having the following formula: $R^1$—O-$(EO)x_4(PO)y_4$-H, wherein $R^1$ is a straight-chain $C_{10}$-$C_{16}$-alkyl, and wherein $x_4$=4-8, preferably 4-5.5, and wherein $y_4$=2-5, preferably 3.5-5. In an aspect, the surfactant system includes from about 5-80 parts by weight of at least one alkoxylate of the formula $R^1$—O-$(EO)x_4(PO)y_4$-H, wherein $R^1$ is a straight-chain $C_{10}$-$C_{16}$-alkyl, and wherein $x_4$=4-8, preferably 4-5.5, and wherein $y_4$=2-5, preferably 3.5-5.

In an aspect, the surfactant system includes Surfactant B has the following formula: $R^2$—O-$(EO)_{x1}$—H, wherein $R^2$ is a $C_{10}$-$C_{14}$ alkyl, or preferably a $C_{12}$-$C_{14}$ alkyl, with an average at least 1 branch per residue, or preferably at least 2 branches per residue, and wherein $x_1$=5-10. In an aspect, the surfactant system includes from about 0-80 parts by weight of at least one alkoxylate of the formula $R^2$—O-$(EO)_{x1}$—H, where $R^2$ is a $C_{12}$-$C_{14}$ alkyl with an average at least 2 branches per residue, and wherein $x_1$=5-10, preferably from 5-8.

In an aspect, the surfactant system includes Surfactant C having the following formula: $R^2$—O-$(EO)_{x2}$—H, wherein $R^2$ is a $C_{10}$-$C_{14}$ alkyl, or preferably a $C_{12}$-$C_{14}$ alkyl with an average at least 1 branch per residue, or preferably at least 2 branches per residue, and wherein $x_2$=2-4. In an aspect, the surfactant system includes from about 0-80 parts by weight of at least one alkoxylate of the formula $R^2$—O-$(EO)_{x2}$—H, wherein $R^2$ is a $C_{12}$-$C_{14}$ alkyl with in average at least 2 branches per residue, and wherein $x_2$=2-4.

In an aspect, the surfactant system includes Surfactant D having the following formula: $R^7$—O—$(PO)y_5(EO)x_5(PO)y_6$, wherein $R^7$ is a $C_8$-$C_{16}$ Guerbet alcohol, preferably a $C_{8-12}$ Guerbet alcohol, or more preferably a $C_8$-$C_{10}$ Guerbet alcohol, wherein $x_5$=5-30, preferably 9-22, wherein $y_5$=1-5, preferably 1-4, and wherein $y_6$=10-20. In an aspect, the surfactant system includes from about 0-80 parts by weight of a surfactant $R^7$—O—$(PO)y_5(EO)x_5(PO)y_6$, wherein $R^7$ is a $C_8$-$C_{16}$ Guerbet alcohol, wherein $x_5$=5-30, preferably 9-22, wherein $y_5$=1-5, preferably 1-4, and wherein $y_6$=10-20.

In an aspect, the surfactant system includes Surfactant E having the following formula: $R^6$—O—$(PO)y_4(EO)x_4$, wherein $R^6$ is a $C_8$-$C_{16}$, Guerbet alcohol, preferably a $C_{8-12}$ Guerbet alcohol, or more preferably a $C_8$-$C_{10}$ Guerbet alcohol, wherein $x_4$=2-10, preferably 3-8, wherein $y_4$=1-2. In an aspect, the surfactant system includes from about 0-80 parts by weight of a surfactant $R^6$—O—$(PO)y_4(EO)x_4$, wherein $R^6$ is a $C_8$-$C_{16}$ Guerbet alcohol, wherein $x_4$=2-10, preferably 3-8, wherein $y_4$=1-2.

Hardening Agents

The solid rinse aid compositions can include a variety of solidification agents or hardening agents. In an aspect, the rinse aid composition includes an effective amount of a sulfate for solidification. Examples of suitable sulfates for use in the composition of the invention include but are not limited to sodium ethyl hexyl sulfate, sodium linear octyl sulfate, sodium lauryl sulfate, and sodium sulfate. Additional sulfates, including alkyl benzene and/or alkyl naphthalene sulfonate are disclosed above and can be formulated for efficacy as a hardening agent. In general, an effective amount of effective amount of sodium sulfate is considered an amount that acts with or without other materials to solidify the rinse aid composition. Typically, the amount of sodium sulfate in a solid rinse aid composition is in a range of 1 to 70 wt-% by weight of the solid rinse aid composition, preferably from about 1-25 wt-% sodium sulfate.

In an aspect, the rinse aid composition includes an effective amount of urea for solidification. In general, an effective amount of urea is considered an amount that acts with or without other materials to solidify the rinse aid composition. In some embodiments the urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, preferably about 75-100 U.S. mesh, preferably using a wet mill such as a single or twin-screw extruder, a Teledyne mixer, a Ross emulsifier, and the like. Urea hardening agents are disclosed, including ratios of urea to water or other components in an acidic composition, for example in U.S. Pat. Nos. 5,698,513 and 7,279,455, which are herein incorporated by reference in their entirety. In general, an effective amount of effective amount of urea is considered an amount that acts with or without other materials to solidify the rinse aid composition. Typically, the amount of urea in a solid rinse aid composition is in a range of 1 to 70 wt-% by weight of the solid rinse aid composition, preferably from about 15-50 wt-% urea.

In a further aspect, the rinse aid composition includes an effective amount of a polyethylene glycol. A combination of the hardening agents may further be employed as disclosed herein. In some embodiments, hardening agents may include a combination or single agent selected from the group consisting of solid acid, urea, sodium xylene sulfonate, sodium acetate, sodium sulfate, sodium carbonate, sodium tripoly phosphate, polyethylene glycol and combinations thereof. Without being limited to a particular mechanism of action, it has been shown according to the invention that extruded and cast solid embodiments of the invention preferably employ urea, polyethylene glycol and combinations thereof, whereas pressed embodiments of the invention preferably employ sodium xylene sulfonate. In some embodiments the combination of a solid acid and urea hardening agent yield a preferred solid embodiment with the use of the salt of the solid acid, such as monosodium citrate in combination with urea instead of citric acid with urea.

Water

The solid rinse aid composition can in some embodiments includes water. Water many be independently added to the solid rinse aid composition or may be provided in the solid rinse aid composition as a result of its presence in a material that is added to the solid rinse aid composition. For example, materials added to the solid rinse aid composition include water or may be prepared in an aqueous premix available for reaction with the solidification agent component(s). Typically, water is introduced into the solid rinse aid composition to provide the composition with a desired viscosity prior to solidification, and to provide a desired rate of solidification.

In general, it is expected that water may be present as a processing aid and may be removed or become water of hydration. It is expected that water may be present in the solid composition. In the solid composition, it is expected that the water will be present in the solid rinse aid composition in the range of between 0 wt. % and 5 wt. %. For example, water is present in embodiments of the solid rinse aid composition in the range of between 0.1 wt. % to about 5 wt. %, or further embodiments in the range of between 0.5 wt. % and about 4 wt. %, or yet further embodiments in the range of between 1 wt. % and 3 wt. %. It should be additionally appreciated that the water may be provided as deionized water or as softened water.

The components used to form the solid composition can include water as hydrates or hydrated forms of the binding agent, hydrates or hydrated forms of any of the other ingredients, and/or added aqueous medium as an aid in processing. It is expected that the aqueous medium will help provide the components with a desired viscosity for processing. In addition, it is expected that the aqueous medium may help in the solidification process when is desired to form the concentrate as a solid.

Additional Functional Ingredients

The components of the rinsing compositions can further be combined with various functional components suitable for use in ware wash and other applications. In some embodiments, few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, including processing aids, threshold inhibitor, builders, hydrotropes or couplers, defoaming agents, bleaching agents, activators, fillers, anti-redeposition agents, enzymes, dyes/odorants, and additional surfactants. The particular materials discussed are given by way of example only and a broad variety of other functional ingredients may be used. For example, many of the functional materials discussed below relate to materials used in cleaning, specifically ware wash applications. However, other embodiments may include functional ingredients for use in other applications.

In other embodiments, the compositions may include defoaming agents, additional surfactants and surfactant classes, anti-redeposition agents, bleaching agents, solubility modifiers, dispersants, additional rinse aids, antiredeposition agents, an anti-microbial agent, metal protecting agents and/or etch protection convention for use in ware-washing applications, stabilizing agents, corrosion inhibitors, additional sequestrants and/or chelating agents, threshold inhibitors, enzymes, humectants, pH modifiers, fragrances and/or dyes, rheology modifiers or thickeners, hydrotropes or couplers, buffers, solvents and the like.

Processing Aids

In some embodiments the solid rinse aid composition can include additional processing aids. Examples of processing aids include an amide such as stearic monoethanolamide or lauric diethanolamide, or an alkylamide, and the like; a solid polyethylene glycol, or a solid EO/PO block copolymer, urea and the like; starches that have been made water-soluble through an acid or alkaline treatment process; various inorganics that impart solidifying properties to a heated composition upon cooling, and the like. Such compounds may also vary the solubility of the composition in an aqueous medium during use such that the rinse aid and/or other active ingredients may be dispensed from the solid composition over an extended period of time. The composition may include a secondary hardening agent in an amount in the range of up to about 10 wt %. In some embodiments, secondary hardening agents are may be present in an amount in the range of 0-10 wt %, often in the range of 0 to 7.5 wt % and sometimes in the range of about 0 to about 5 wt-%.

Threshold Inhibitor

The solid rinse aid composition may also include effective amounts of a threshold inhibitor. The threshold inhibitor inhibits precipitation at dosages below the stoichiometric level (i.e. sub-stoichiometric) required for sequestration or chelation. Beneficially the threshold inhibitor affects the kinetics of the nucleation and crystal growth of scale-forming salts to prevent scale formation. A preferred class of threshold agents for the solid rinse aid compositions includes polyacrylic acid polymers, preferably low molecular weight acrylate polymers. Polyacrylic acid homopolymers can contain a polymerization unit derived from the monomer selected from the group consisting of acrylic acid, methacrylic acid, methyl acrylate, methyl methacrylate, ethyl acrylate, ethyl methacrylate, butyl acrylate, butyl methacrylate, iso-butyl acrylate, iso-butyl methacrylate, iso-octyl acrylate, iso-octyl methacrylate, cyclohexyl acrylate, cyclohexyl methacrylate, glycidyl acrylate, glycidyl methacrylate, hydroxyethyl acrylate, hydroxypropyl acrylate, 2-hydroxyethyl acrylate, 2-hydroxyethyl methacrylate, 2-hydroxypropyl acrylate, 2-hydroxypropyl methacrylate, and hydroxypropyl methacrylate and a mixture thereof, among which acrylic acid. methacrylic acid, methyl acrylate, methyl methacrylate, butyl acrylate, butyl methacrylate, iso-butyl acrylate, iso-butyl methacrylate, hydroxyethyl acrylate, 2-hydroxyethyl acrylate, 2-hydroxyethyl methacrylate, 2-hydroxypropyl acrylate, and 2-hydroxypropyl methacrylate, and a mixture thereof are preferred.

Preferred are polyacrylic acids, $(C_3H_4O_2)_n$ or 2-Propenoic acid homopolymers; Acrylic acid polymer; Poly(acrylic acid); Propenoic acid polymer; PAA have the following structural formula:

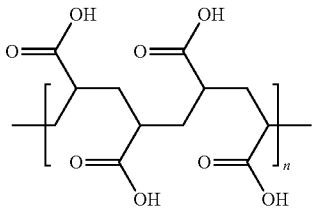

where n is any integer.

One source of commercially available polyacrylates (polyacrylic acid homopolymers) useful for the invention includes the Acusol 445 series from The Dow Chemical Company, Wilmington Del., USA, including, for example, Acusol® 445 (acrylic acid polymer, 48% total solids) (4500 MW), Acusol® 445N (sodium acrylate homopolymer, 45% total solids)(4500MW), and Acusol®445ND (powdered sodium acrylate homopolymer, 93% total solids)(4500MW) Other polyacrylates (polyacrylic acid homopolymers) commercially available from Dow Chemical Company suitable for the invention include, but are not limited to Acusol 929 (10,000 MW) and Acumer 1510. Yet another example of a commercially available polyacrylic acid is AQUATREAT AR-6 (100,000 MW) from AkzoNobel Strawinskylaan 2555 1077 ZZ Amsterdam Postbus 75730 1070 AS Amsterdam. Other suitable polyacrylates (polyacrylic acid homopolymers) for use in the invention include, but are not limited to those obtained from additional suppliers such as Aldrich Chemicals, Milwaukee, Wis., and ACROS Organics and Fine Chemicals, Pittsburgh, Pa., BASF Corporation and SNF Inc. Additional disclosure of polyacrylates suitable for use in the solid rinse aid compositions is disclosed in U.S. Application Ser. No. 62/043,572 which is herein incorporated by reference in its entirety.

The threshold inhibitor, if present may be in an amount of from about 0.1 wt-% to about 30 wt-%, preferably from about 1 wt-% to about 25 wt-% and more preferably from about 5 wt-% to about 20 wt-% of the solid rinse aid composition.

Builders

The solid rinse aid composition may also include effective amounts of a builder. Suitable additional builders include polycarboxylates. Some examples of polymeric polycarboxylates suitable for use as sequestering agents include those having a pendant carboxylate (—$CO_2$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

In embodiments of the solid rinse aid composition which are not aminocarboxylate-free may include added builders which are aminocarboxylates. Some examples of aminocarboxylic acids include, N-hydroxyethyliminodiacetic acid, nitrilotriacetic acid (NTA), ethylenediaminetetraacetic acid (EDTA), N-hydroxyethyl-ethylenediaminetriacetic acid (HEDTA) (in addition to the HEDTA used in the binder), diethylenetriaminepentaacetic acid (DTPA), and the like.

In some applications the solid rinse aid composition is also phosphate-free and/or amino-carboxylate-free. In embodiments of the solid rinse aid composition that are phosphate-free, the additional functional materials, including threshold inhibitors and/or builders exclude phosphorous-containing compounds such as condensed phosphates and phosphonates.

In embodiments of the solid rinse aid composition which are not phosphate-free, added builders may include, for example a condensed phosphate, a phosphonate, and the like. Some examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

In embodiments of the solid rinse aid composition which are not phosphate-free, the composition may include a phosphonate such as 1-hydroxyethane-1,1-diphosphonic acid $CH_3C(OH)[PO(OH)_2]_2$; aminotri(methylenephosphonic acid) $N[CH_2PO(OH)_2]_3$; aminotri(methylenephosphonate), sodium salt

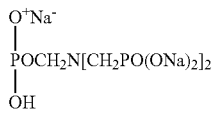

2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene)triamine(pentamethylenephosphonic acid) $(HO_2)POCH_2N[(CH_2)_6N[CH_2PO(OH)_2]_2]_2$; and phosphorus acid $H_3PO_3$. In some embodiments, a phosphonate combination such as ATMP and DTPMP may be used. A neutralized or alkaline phosphonate, or a combination of the phosphonate with an alkali source prior to being added into the mixture such that there is little or no heat or gas generated by a neutralization reaction when the phosphonate is added can be used.

For a further discussion of builders, see Kirk-Othmer, Encyclopedia of Chemical Technology, Third Edition, volume 5, pages 339-366 and volume 23, pages 319-320, the disclosure of which is incorporated by reference herein.

The builder, if present may be in an amount of from about 0.1 wt-% to about 30 wt-%, preferably from about 1 wt-% to about 25 wt-% and more preferably from about 5 wt-% to about 20 wt-%. In some embodiments, the solid acid may also perform as a chelant.

Hydrotropes or Couplers

In some embodiments, the compositions of the present invention can include a hydrotrope or coupler. These may be used to aid in maintaining the solubility of the wetting and/or defoaming surfactants as well as a coupling agent for the peroxycarboxylic acid components. In some embodiments, hydrotropes are low molecular weight n-octane sulfonate and aromatic sulfonate materials such as alkyl benzene sulfonate, xylene sulfonates, naphthalene sulfonate, dialkyldiphenyl oxide sulfonate materials, and cumene sulfonates.

A hydrotrope or combination of hydrotropes can be present in the compositions at an amount of from between about 1 wt-% to about 50 wt-%. In other embodiments, a hydrotrope or combination of hydrotropes can be present at about 10 wt-% to about 40 wt-% of the composition. Without limiting the scope of invention, the numeric ranges are inclusive of the numbers defining the range and include each integer within the defined range.

Defoaming Agent

The present invention may include a defoaming agent. Defoaming agents suitable for use in the solid rinse aid compositions maintain a low foam profile under various water conditions, preferably under deionized or soft water conditions, and/or under mechanical action. In a still further aspect, the defoaming agents are compatible with surfactants, preferably nonionic surfactants, to achieve critical performance such as coupling/wetting, and improved material compatibility.

The defoaming agent is present at amount effective for reducing the stability of foam that may be created by the sheeting agent in an aqueous solution. The defoaming agent can also contribute to the sheeting performance of the compositions of the present invention. Any of a broad variety of suitable defoamers may be used, for example, any of a broad variety of nonionic ethylene oxide (EO) containing surfactants. Many nonionic ethylene oxide derivative surfactants are water soluble and have cloud points below the intended use temperature of the rinse aid composition, and therefore may be useful defoaming agents.

While not wishing to be bound by theory, it is believed that suitable nonionic EO containing surfactants are hydrophilic and water soluble at relatively low temperatures, for example, temperatures below the temperatures at which the rinse aid will be used. It is theorized that the EO component forms hydrogen bonds with the water molecules, thereby solubilizing the surfactant. However, as the temperature is increased, these hydrogen bonds are weakened, and the EO containing surfactant becomes less soluble, or insoluble in water. At some point, as the temperature is increased, the cloud point is reached, at which point the surfactant precipitates out of solution, and functions as a defoamer. The surfactant can therefore act to defoam the sheeting agent component when used at temperatures at or above this cloud point.

Some examples of ethylene oxide derivative surfactants that may be used as defoamers include polyoxyethylene-polyoxypropylene block copolymers, alcohol alkoxylates, low molecular weight EO containing surfactants, or the like, or derivatives thereof. Some examples of polyoxyethylene-polyoxypropylene block copolymers include those having the following formulae:

$$(EO)x(PO)y(EO)x$$

$$(PO)y(EO)x(PO)y$$

$$(PO)_y(EO)_x(PO)_y(EO)_x(PO)_y$$

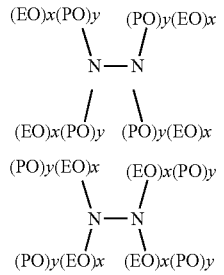

wherein EO represents an ethylene oxide group, PO represents a propylene oxide group, and x and y reflect the average molecular proportion of each alkylene oxide monomer in the overall block copolymer composition. In some embodiments, x is in the range of about 10 to about 130, y is in the range of about 15 to about 70, and x plus y is in the range of about 25 to about 200. It should be understood that each x and y in a molecule can be different. In some embodiments, the total polyoxyethylene component of the block copolymer can be in the range of at least about 20 mol-% of the block copolymer and in some embodiments, in the range of at least about 30 mol-% of the block copolymer. In some embodiments, the material can have a molecular weight greater than about 400, and in some embodiments, greater than about 500. For example, in some embodiments, the material can have a molecular weight in the range of about 500 to about 7000 or more, or in the range of about 950 to about 4000 or more, or in the range of about 1000 to about 3100 or more, or in the range of about 2100 to about 6700 or more.

Although the exemplary polyoxyethylene-polyoxypropylene block copolymer structures provided above have 3-8 blocks, it should be appreciated that the nonionic block copolymer surfactants can include more or less than 3 or 8 blocks. In addition, the nonionic block copolymer surfactants can include additional repeating units such as butylene oxide repeating units. Furthermore, the nonionic block copolymer surfactants that can be used according to the invention can be characterized heteric polyoxyethylene-polyoxypropylene block copolymers. Some examples of suitable block copolymer surfactants include commercial products such as PLURONIC® and TETRONIC® surfactants, commercially available from BASF. For example, PLURONIC® 25-R2 is one example of a useful block copolymer surfactant commercially available from BASF.

The defoamer component can comprise a very broad range of weight percent of the entire composition, depending upon the desired properties. For example, for concentrated embodiments, the defoamer component can comprise in the range of 1 to about 10 wt % of the total composition, in some embodiments in the range of about 2 to about 5 wt % of the total composition, in some embodiments in the range of about 20 to about 50 wt % of the total composition, and in some embodiments in the range of about 40 to about 90 wt % of the total composition. For some diluted or use solutions, the defoamer component can comprise in the range of 5 to about 60 ppm of the total use solution, in some embodiments in the range of about 50 to about 150 ppm of the total use solution, in some embodiments in the range of about 100 to about 250 ppm of the total use solution, and in some embodiments in the range of about 200 to about 500 ppm of the use solution.

The amount of defoaming agent present in the composition can also be dependent upon the amount of sheeting agent present in the composition. For example, less sheeting agent present in the composition may provide for the use of less defoamer component. In some example embodiments, the ratio of weight-percent sheeting agent component to weight-percent defoamer component may be in the range of about 1:5 to about 5:1, or in the range of about 1:3 to about 3:1. The ratio of sheeting agent component to defoamer component may be dependent on the properties of either and/or both actual components used, and these ratios may vary from the example ranges given to achieve the desired defoaming effect.

In an alternative aspect of the invention, the defoaming agent is a metal salt, including for example, aluminum, magnesium, calcium, zinc and/or other rare earth metal salts. In a preferred aspect, the defoaming agent is a cation with high charge density, such as $Fe^{3+}$, $Al^{3+}$ and $La^{3+}$. In a preferred aspect, the defoaming agent is aluminum sulfate. In other aspects, the defoaming agent is not a transition metal compound. In some embodiments, the compositions of the present invention can include antifoaming agents or defoamers which are of food grade quality, including for example silicone-based products, given the application of the method of the invention.

In an aspect of the invention, the defoaming agent can be used at any suitable concentration to provide defoaming with the surfactants according to the invention. In some embodiments, a concentrated equilibrium composition has a concentration of the defoaming agent from about 0.001 wt-% to about 10 wt-%, or from about 0.1 wt-% to about 5 wt-%. In still other embodiments, the defoaming agent has a concentration from about 0.1 wt-% to about 1 wt-%. Without limiting the scope of invention, the numeric ranges are inclusive of the numbers defining the range and include each integer within the defined range.

Bleaching Agents

The rinse aid can optionally include bleaching agent. As one skilled in the art will recognize, embodiments of the solid rinse aid composition employing urea as a solidification agent for the solid rinse aid composition will not include bleaching agents, such as chlorine which would react with the urea. However, in other embodiments, the solid acid rinse aid compositions may employ a bleaching agent.

Bleaching agent can be used for lightening or whitening a substrate, and can include bleaching compounds capable of liberating an active halogen species, such as $Cl_2$, $Br_2$, —$OCl^-$ and/or —$OBr^-$, or the like, under conditions typically encountered during the cleansing process. Suitable bleaching agents for use can include, for example, chlorine-containing compounds such as a chlorine, a hypochlorite, chloramines, of the like. Some examples of halogen-releasing compounds include the alkali metal dichloroisocyanurates, chlorinated trisodium phosphate, the alkali metal hypochlorites, monochloramine and dichloroamine, and the like. Encapsulated chlorine sources may also be used to enhance the stability of the chlorine source in the composition (see, for example, U.S. Pat. Nos. 4,618,914 and 4,830,773, the disclosures of which are incorporated by reference herein). A bleaching agent may also include an agent containing or acting as a source of active oxygen. The active oxygen compound acts to provide a source of active oxygen, for example, may release active oxygen in aqueous solutions. An active oxygen compound can be inorganic or organic, or can be a mixture thereof. Some examples of active oxygen compound include peroxygen compounds, or peroxygen compound adducts. Some examples of active oxygen compounds or sources include hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A rinse aid composition may include a minor but effective amount of a bleaching agent, for example, in some embodiments, in the range of up to about 10 wt-%, and in some embodiments, in the range of about 0.1 to about 6 wt-%.

Activators

In some embodiments, the antimicrobial activity or bleaching activity of the rinse aid can be enhanced by the addition of a material which, when the composition is placed in use, reacts with the active oxygen to form an activated component. For example, in some embodiments, a peracid or a peracid salt is formed. For example, in some embodiments, tetraacetylethylene diamine can be included within the composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof.

In some embodiments, an activator component can include in the range of up to about 75% by wt. of the composition, in some embodiments, in the range of about 0.01 to about 20% by wt, or in some embodiments, in the range of about 0.05 to 10% by weight of the composition. In some embodiments, an activator for an active oxygen compound combines with the active oxygen to form an antimicrobial agent.

In some embodiments, the rinse aid composition includes a solid, such as a solid flake, pellet, or block, and an activator material for the active oxygen is coupled to the solid. The activator can be coupled to the solid by any of a variety of methods for coupling one solid composition to another. For example, the activator can be in the form of a solid that is bound, affixed, glued or otherwise adhered to the solid of the rinse aid composition. Alternatively, the solid activator can be formed around and encasing the solid rinse aid composition. By way of further example, the solid activator can be coupled to the solid rinse aid composition by the container or package for the composition, such as by a plastic or shrink wrap or film.

Fillers

The rinse aid can optionally include a minor but effective amount of one or more of a filler which does not necessarily perform as a rinse and/or cleaning agent per se, but may cooperate with a rinse agent to enhance the overall capacity of the composition. Some examples of suitable fillers may include sodium chloride, starch, sugars, $C_1$-$C_{10}$ alkylene glycols such as propylene glycol, and the like. In some embodiments, a filler can be included in an amount in the range of up to about 20 wt-%, and in some embodiments, in the range of about 1-15 wt-%. Sodium sulfate is conventionally used as inert filler.

Anti-Redeposition Agents

The rinse aid compositions can optionally include an anti-redeposition agent capable of facilitating sustained suspension of soils in a rinse solution and preventing removed soils from being redeposited onto the substrate being rinsed. Some examples of suitable anti-redeposition agents can include fatty acid amides, fluorocarbon surfactants, complex phosphate esters, styrene maleic anhydride copolymers, and cellulosic derivatives such as hydroxyethyl cellulose, hydroxypropyl cellulose, and the like. A rinse aid composition may include up to about 10 wt-% of an anti-redeposition agent.

Enzymes

The solid rinse aid compositions can optionally include an enzyme or enzymes, and optionally enzyme stabilizers. In an embodiment, solid compositions containing enzymes employ a near-neutral pH for the use solutions thereof. In some embodiments the pH is from about 5 to about 7, or about 6 to about 7, or near 7.

The hydrolases catalyze the addition of water to the soil with which they interact and generally cause a degradation or breakdown of that soil residue. This breakdown of soil residue is of particular and practical importance in detergent applications because soils adhering to surfaces are loosened and removed or rendered more easily removed by detersive action. Thus, hydrolases are a suitable class of enzymes for use in cleaning compositions. Particularly suitable hydrolases include, but are not limited to: esterases, carbohydrases, and proteases. In particular, proteases are suitable for the compositions of the present invention.

The proteases catalyze the hydrolysis of the peptide bond linkage of amino acid polymers. For example, the proteases can catalyze peptides, polypeptides, proteins and related substances, generally protein complexes, such as casein which contains carbohydrate (glyco group) and phosphorus as integral parts of the protein and exists as distinct globular particles held together by calcium phosphate. Other globular particles include milk globulins which can be thought of as protein and lipid sandwiches that include the milk fat globule membrane. Proteases thus cleave complex, macromolecular protein structures present in soil residues into simpler short chain molecules which are, of themselves, more readily desorbed from surfaces, solubilized or otherwise more easily removed by detersive solutions containing said proteases. Proteases are further divided into three distinct subgroups which are grouped by the pH optima (i.e. optimum enzyme activity over a certain pH range). These three subgroups are the alkaline, neutral and acids proteases. Particularly suitable for this invention are pH neutral proteases.

Examples of commercially available proteolytic enzymes which can be employed in the composition of the invention include (with trade names) Savinase; a protease derived from *Bacillus lentus* type; a protease derived from *Bacillus licheniformis*, such as Alcalase; and a protease derived from *Bacillus amyloliquefaciens*, such as Primase.

Lipase enzymes suitable for the composition of the present invention can be derived from a plant, an animal, or a microorganism. Because lipases can also be advantageous for cleaning soils containing fat, oil, or wax, such as animal or vegetable fat, oil, or wax (e.g., salad dressing, butter, lard, chocolate, lipstick), lipases can be used as the enzyme in the second enzymatic composition. In addition, cellulases can be advantageous for cleaning soils containing cellulose or containing cellulose fibrin that serve as attachment points for other soil. Suitable lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be pure or a component of an extract, and either wild or a variant (either chemical or recombinant). Examples of lipase enzymes that can be employed in the composition of the invention include those sold under the trade names Lipase P "Amano" or "Amano-P" by Amano Pharmaceutical Co. Ltd., Nagoya, Japan or under the trade name Lipolase® by Novoenzymes, and the like. Other commercially available lipases that can be employed in the present solid compositions include Amano-CES, lipases derived from Chromobacter *viscosum*, e.g. Chromobacter *viscosum* var. lipolyticum NRRLB 3673 from Toyo Jozo Co., Tagata, Japan; Chromobacter *viscosum* lipases from U.S. Biochemical Corp., U.S.A. and Disoynth Co., and lipases derived from *Pseudomonas gladioli* or from *Humicola lanuginosa*.

Amylases suitable for the composition of the present invention can be derived from a plant, an animal, or a microorganism. The amylase can be pure or a component of a microbial extract, and either wild or a variant (either chemical or recombinant), particularly a variant that is more stable under washing or presoak conditions than a wild type amylase. A mixture of amylases can also be used.

Cellulases suitable for the composition of the present invention can be derived from a plant, an animal, or a microorganism. The cellulase can be purified or a component of a microbial extract, and either wild type or variant (either chemical or recombinant), particularly a variant that is more stable under washing or presoak conditions than a wild type amylase.

Additional enzymes suitable for use in the present solid compositions include a cutinase, a peroxidase, a gluconase, and the like and can be derived from a plant, an animal, or a microorganism. The enzyme can be pure or a component of a microbial extract, and either wild or a variant (either chemical or recombinant), particularly a variant that is more stable under washing or presoak conditions than a wild type amylase.

Mixtures of different additional enzymes can be incorporated into the present invention. While various specific enzymes have been described above, it is to be understood that any additional enzyme which can confer the desired enzyme activity to the composition can be used and this embodiment of this invention is not limited in any way by a specific choice of enzyme.

Dyes/Odorants

Various dyes, odorants including perfumes, and other aesthetic enhancing agents may also be included in the rinse aid. Dyes may be included to alter the appearance of the composition, as for example, FD&C Blue 1 (Sigma Chemical), FD&C Yellow 5 (Sigma Chemical), Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as CIS jasmine or jasmal, vanillin, and the like.

Additional Surfactants

In addition to the nonionic surfactants specified above, the composition may also include other surfactants as enumerated hereinafter.

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

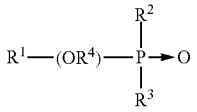

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

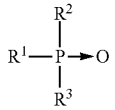

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

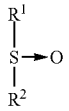

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, isododecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$), Dehypon LS-36 (R-$(EO)_3(PO)_6$) and Genapol 2454; and capped alcohol alkoxylates, such as Plurafac LF22, Plurafac RA 300 and Tegoten EC11; mixtures thereof, or the like.

Anionic Surfactants

Certain embodiments of the invention contemplate the use of one or more anionic surfactants which electrostatically interact or ionically interact with the positively charged polymer to enhance foam stability. Anionic surfactants are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore traditionally favored additions to heavy duty detergent compositions as well as rinse aids. Generally, anionics have high foam profiles which are useful for the present foaming cleaning compositions. Anionic surface active compounds are useful to impart special chemical or physical properties other than detergency within the composition.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989).

The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. A particularly preferred anionic surfactant is alpha olefin sulfonate. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like. The fifth class includes sulfuric acid esters (and salts), such as alkyl ether sulfates, alkyl sulfates, and the like. A particularly preferred anionic surfactant is sodium laurel ether sulfate.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein). Ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Examples of suitable synthetic, water soluble anionic surfactant compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic surfactants suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy)sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

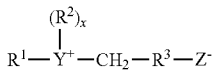

wherein R1 contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxy late, sulfonate, sulfate, phosphonate, and phosphate groups.

Examples of zwitterionic surfactants having the structures listed above include: 4-[N,N-di(2-hydroxyethyl)-N-octadecylammonio]-butane-1-car-boxylate; 5-[S-3-hydroxypropyl-S-hexadecylsulfonio]-3-hydroxypentane-1-sul-fate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propan-e-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N (2-hydroxydodecyl)ammonio]-butane-1-carboxyl-ate; 3-[S-ethyl-S-(3-dodecoxy-2-hydroxypropyl)sulfonio]-propane-1-phosphat-e; 3-[P,P-dimethyl-P-dodecylphosphonio]-propane-1-phosphonate; and S [N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

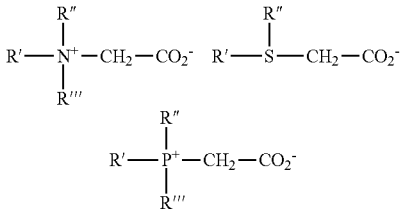

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R1)_2N.sup.+R^2SO^3$—, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Betaines and sultaines and other such zwitterionic surfactants are present in an amount of from Anionic surfactants are present in the composition in any detersive amount which can range typically from about 0.01 wt-% to about 75 wt-% of the rinse aid composition. In a preferred embodiment, about 10 wt-% to about 30 wt-% and more preferably from about 15 wt-% to about 25 wt-%.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

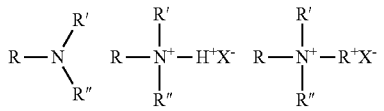

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xYLZ$ wherein each $R^1$ is an organic group containing a straight or branched alkyl or alkenyl group optionally substituted with up to three phenyl or hydroxy groups and optionally interrupted by up to four of the following structures:

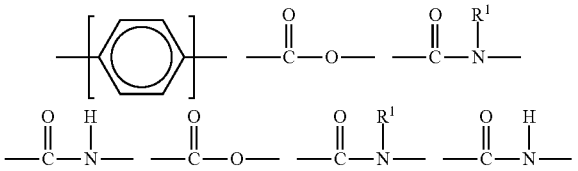

or an isomer or mixture of these structures, and which contains from 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group is filled by hydrogens.

Y can be a group including, but not limited to:

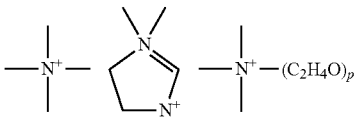

p = about 1 to 12

-continued

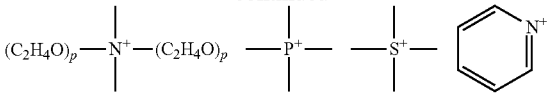

p = about 1 to 12

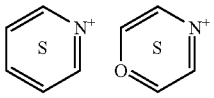

or a mixture thereof.

Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

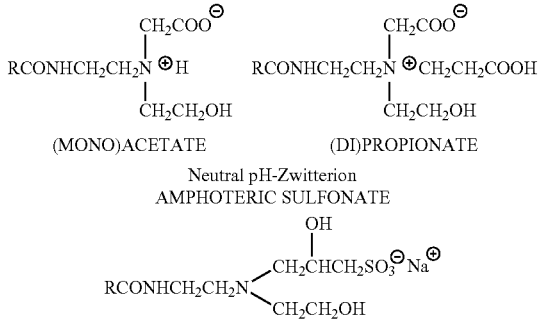

wherein R is an acyclic hydrophobic group containing from 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R.dbd.$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Additional surfactant may be present in the compositions in any detersive amount so long as they do not interfere with the electrostatic, ionic interactions that provide for foam stabilization.

Solid Compositions

In an embodiment of the invention, the solid rinse aid composition is provided as a solid, such as a block, or a compressed solid in the form of a tablet or block. In addition to other benefits disclosed herein, the solid rinse aid composition stabilizes the pyrithione preservative system with the solid acid disposed therein. Without being limited to a particular mechanism of action the pyrithione preservative system would not be stable in a liquid formulation at an acidic pH and therefore the solid beneficially overcomes this limitation.

In an embodiment, the solid compositions are dimensionally stable. The terms "dimensional stability" and "dimensionally stable" as used herein, refer to a solid product having a growth exponent of less than about 5%, less than about 4%, less than about 3%, preferably less than about 2%, if heated at a temperature of 120 degrees Fahrenheit and at a relative humidity of 40% to 60%, or preferably if heated at a temperature of 120 degrees Fahrenheit and at a relative humidity of 50%.

In additional embodiments, the solid compositions are solids in that they have a distinct solid character, have a measurable penetrometer value and melt at elevated temperatures. Preferred solids have a penetrometer value between about 3 and about 80; the lower the penetrometer value, the harder the solid block material.

In yet another embodiment, the solid rinse aid composition is provided in a solid form that resists crumbling or other degradation until placed into a container. Such container may either be filled with water before placing the composition concentrate into the container, or it may be filled with water after the composition concentrate is placed into the container, or water may contact a portion of the surface of the solid in the container. In any case, the solid composition dissolves, solubilizes, or otherwise disintegrates upon contact with water. In a preferred embodiment, the solid composition dissolves rapidly thereby allowing the concentrate composition to become a use composition containing the preservative system and further allowing the end user to apply the use composition to a surface in need of cleaning.

In a preferred embodiment, the solid composition can be diluted through dispensing equipment whereby water is sprayed at a solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution containing the preservative system as the solid concentrate dissolves. The solid concentrate composition can also be diluted through pellet, tablet, powder and paste dispensers, and the like.

Methods of Making the Solid Compositions

The solid composition, namely rinse aid compositions, can be made by any advantageous method of solidification, including for example pressing and/or extruding the solid composition. Specifically, in a forming process, the liquid and solid components are introduced into the final mixing system and are continuously mixed until the components form a substantially homogeneous semi-solid mixture in which the components are distributed throughout its mass.

In an exemplary embodiment, the components are mixed in the mixing system for at least approximately 5 seconds, 10 seconds, 20 seconds, 30 seconds, 45 seconds, or longer. In some embodiments, the components are mixed in the mixing system for at least approximately 1 minute or longer. The mixture is then discharged from the mixing system into, or through, a die, press or other shaping means. The product is then packaged. In an exemplary embodiment, the solid formed composition begins to harden between approximately 1 minute and approximately 3 hours. Particularly, the formed composition begins to harden in between approximately 1 minute and approximately 2 hours. More particularly, the formed composition begins to harden in between approximately 1 minute and approximately 20 minutes.

In a further exemplary embodiment, the manufacture and use of a solid block cleaning compositions are as disclosed in Fernholz et al., U.S. Reissue Pat. Nos. 32,763 and 32,818 and in Heile et al., U.S. Pat. Nos. 4,595,520 and 4,680,134 and are hereby incorporated by reference in their entirety for all purposes. In the manufacture of solid compositions, various hardening mechanisms have been used in the manufacture of solid compositions for the manufacture of the solid block. Active ingredients are often combined with a hardening agent under conditions that convert the hardening agent from a liquid to a solid rendering the solid material into a mechanically stable block format. The material cools, solidifies and is ready for use. The suspended or solubilized materials are evenly dispersed throughout the solid and are dispensed upon contact with water to generate a use solution.

Solid pelletized materials as shown in Gladfelter, U.S. Pat. Nos. 5,078,301, 5,198,198 and 5,234,615 and in Gansser U.S. Pat. Nos. 4,823,441 and 4,931,202 all incorporated herein by reference in their entirety for all purposes are useful in preparing a solid composition of the present invention. Such pelletized materials are typically made by extruding a molten liquid or by compressing a powder into a tablet or pellet as commonly known in the art. Extruded nonmolten alkaline detergent materials are disclosed in Gladfelter et al., U.S. Pat. No. 5,316,688 also incorporated herein by reference in its entirety for all purposes.

Urea occlusion solidification as shown in U.S. Pat. No. 4,624,713 to Morganson et al. is useful in preparing a solid composition of the present invention. Hardeners such as anhydrous sodium acetate and the like, are useful materials in forming a solid concentrate composition. The use of solidifiers or hardeners allows for a higher level of liquid actives to be incorporated into the solid concentrate composition.

In a pressed solid process, a flowable solid, such as granular solids or other particle solids are combined under pressure. In a pressed solid process, flowable solids of the compositions are placed into a form (e.g., a mold or container). The method can include gently pressing the flowable solid in the form to produce the solid cleaning composition. Pressure may be applied by a block machine or a turntable press, or the like. Pressure may be applied at about 1 to about 2000 psi, which refers to the "pounds per square inch" of the actual pressure applied to the flowable solid being pressed and does not refer to the gauge or hydraulic pressure measured at a point in the apparatus doing the pressing. The method can include a curing step to produce the solid cleaning composition. As referred to herein, an uncured composition including the flowable solid is compressed to provide sufficient surface contact between particles making up the flowable solid that the uncured composition will solidify into a stable solid cleaning composition. A sufficient quantity of particles (e.g. granules) in contact with one another provides binding of particles to one another effective for making a stable solid composition. Inclusion of a curing step may include allowing the pressed solid to solidify for a period of time, such as a few hours, or about 1 day (or longer). In additional aspects, the methods could include vibrating the flowable solid in the form or mold, such as the methods disclosed in U.S. Pat. No. 8,889,048, which is herein incorporated by reference in its entirety. While the invention advantageously may be formed to solid by pressing, other methods of solid formation may also be used such as extrusion, cast molding and the like. In some embodiments extruded and pressed solidification are preferred.

In an embodiment of the invention, solid compositions of the present invention can produce a stable solid without employing a melt and solidification of the melt as in conventional casting. Forming a melt requires heating a composition to melt it, creating a number of safety precautions and equipment required. Further, solidification of a melt requires cooling the melt in a container to solidify the melt and form the cast solid. Cooling requires time and/or energy. In contrast, the methods of forming the solid composition according to the invention can preferably employ ambient temperature and humidity during solidification or curing of the present compositions. The solids of the present invention are held together not by solidification from a melt but by a binding agent produced in the admixed particles and that is effective for producing a stable solid.

The solid detergent compositions may be formed using a batch or continuous mixing system. In an exemplary embodiment, a single- or twin-screw extruder may be used to combine and mix one or more components agents at high shear to form a homogeneous mixture. In some embodiments, the processing temperature is at or below the melting temperature of the components. The processed mixture may be dispensed from the mixer by pressing, forming, extruding or other suitable means, whereupon the composition hardens to a solid form. The structure of the matrix may be characterized according to its hardness, melting point, material distribution, crystal structure, and other like properties according to known methods in the art. Generally, a solid composition processed according to the method of the invention is substantially homogeneous with regard to the distribution of ingredients throughout its mass and is dimensionally stable.

The resulting solid composition may take forms including, but not limited to: an extruded, molded or formed solid pellet, block, tablet, powder, granule, flake; or the formed solid can thereafter be ground or formed into a powder, granule, or flake. In an exemplary embodiment, extruded pellet materials formed have a weight of between approximately 50 grams and approximately 250 grams, extruded solids have a weight of approximately 100 grams or greater, and solid blocks formed have a mass of between approximately 1 and approximately 10 kilograms. The solid compositions provide for a stabilized source of functional materials. In a preferred embodiment, the solid composition may be dissolved, for example, in an aqueous or other medium, to create a concentrated and/or use solution. The solution may be directed to a storage reservoir for later use and/or dilution, or may be applied directly to a point of use.

In certain embodiments, the solid rinse aid composition is provided in the form of a unit dose. A unit dose refers to a solid rinse aid composition unit sized so that the entire unit is used during a single washing cycle. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

In other embodiments, the solid rinse aid composition is provided in the form of a multiple-use solid, such as, a block or a plurality of pellets, and can be repeatedly used to generate aqueous rinse compositions for multiple washing cycles. In certain embodiments, the solid rinse aid composition is provided as a solid having a mass of about 5 g to 10 kg. In certain embodiments, a multiple-use form of the solid rinse aid composition has a mass of about 1 to 10 kg. In further embodiments, a multiple-use form of the solid rinse aid composition has a mass of about 5 kg to about 8 kg. In other embodiments, a multiple-use form of the solid rinse aid composition has a mass of about 5 g to about 1 kg, or about 5 g and to 500 g.

Packaging System

The solid rinse aid composition can be, but is not necessarily, incorporated into a packaging system or receptacle. The packaging receptacle or container may be rigid or flexible, and include any material suitable for containing the compositions produced, as for example glass, metal, plastic film or sheet, cardboard, cardboard composites, paper, or the like. Rinse aid compositions may be allowed to solidify in the packaging or may be packaged after formation of the solids in commonly available packaging and sent to distribution center before shipment to the consumer.

For solids, advantageously, in at least some embodiments, since the rinse is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. In some embodiments, the packaging used to contain the rinse aid is manufactured from a flexible, easy opening film material.

Methods of Use

In an aspect, the present invention includes use of the compositions for rinsing surfaces and/or products. In another aspect, the compositions of the invention are particularly suitable for use as a hard surface cleaner, food contact cleaner (including direct or indirect contact), tissue contact cleaner (including for example fruits and vegetables), fast drying aid for various hard surfaces (including for example healthcare surfaces, instruments and instrument washes, food and/or beverage surfaces, processing surfaces, and the like), any-streaking or smearing hard surface cleaner or rinse aid, and the like. The present methods can be used in the methods, processes or procedures described and/or claimed in U.S. Pat. Nos. 5,200,189, 5,314,687, 5,718,910, 6,165,483, 6,238,685B1, 8,017,409 and 8,236,573, each of which are herein incorporated by reference in their entirety.

The methods of use are particularly suitable for warewashing. Suitable methods for using the rinse aid compositions for warewashing are set forth in U.S. Pat. No. 5,578,134, which is herein incorporated by reference in its entirety. Beneficially, according to various embodiments of the invention, the methods provide the following unexpected benefits: decrease in utilities for a warewashing machine to the those expected of commercially-available low temperature ware wash machines, including door machines; utility consumption equivalent to dish machines employed for chlorine-based sanitizing, including for example commercially-available 120 Volt, 30 Amp dishwash machines; and suitable for use with a single, dual-functioning composition containing a detergent(s), rinse additive(s) and an optional additional functional component for sanitizing and/or rinsing. In still further embodiments of the invention, the methods for warewashing may additionally provide any one or more of the following unexpected benefits for warewashing applications: improved ware washing results (including sanitizing efficacy and/or rinsing); decreased total utility costs for door dishmachines; elimination of any need for rewashing of wares; chlorine-free formulations; and/or low phosphorous formulations or substantially phosphorous-free formulations.

Exemplary articles in the warewashing industry that can be treated with a rinse aid composition according to the invention include plastics, dishware, cups, glasses, flatware, and cookware. For the purposes of this invention, the terms "dish" and "ware" are used in the broadest sense to refer to various types of articles used in the preparation, serving, consumption, and disposal of food stuffs including pots, pans, trays, pitchers, bowls, plates, saucers, cups, glasses, forks, knives, spoons, spatulas, and other glass, metal, ceramic, plastic composite articles commonly available in the institutional or household kitchen or dining room. In general, these types of articles can be referred to as food or beverage contacting articles because they have surfaces which are provided for contacting food and/or beverage. When used in these warewashing applications, the rinse aid should provide effective sheeting action and low foaming properties. In addition to having the desirable properties described above, it may also be useful for the rinse aid composition to be biodegradable, environmentally friendly, and generally nontoxic. A rinse aid of this type may be described as being "food grade".

The methods of use are suitable for treating a variety of surfaces, products and/or target in addition to ware. For example, these may include a food item or a plant item and/or at least a portion of a medium, a container, an equipment, a system or a facility for growing, holding, processing, packaging, storing, transporting, preparing, cooking or serving the food item or the plant item. The present methods can be used for treating any suitable plant item. In some embodiments, the plant item is a grain, fruit, vegetable or flower plant item, a living plant item or a harvested plant item. In addition, the present methods can be used for treating any suitable food item, e.g., an animal product, an animal carcass or an egg, a fruit item, a vegetable item, or a grain item. In still other embodiments, the food item may include a fruit, grain and/or vegetable item.

In a still further embodiment, the methods of the invention are suitable for meeting various regulatory standards, including for example EPA food contact sanitizers requiring at least a 5 log reduction in pathogenic microorganisms in 30 seconds and/or NSF standards similarly requiring at least a 5 log reduction in treated pathogenic microorganisms when used in combination with a sanitizing composition. In such aspects when a sanitizing composition may be employed with the rinse aid composition, without limiting the scope of the invention, the methods of the invention may provide sufficient sanitizing efficacy at conditions more or less strenuous than such regulatory standards.

The present methods can be used for treating a target that is at least a portion of a container, an equipment, a system or a facility for holding, processing, packaging, storing, transporting, preparing, cooking or serving the food item or the plant item. In some embodiments, the target is at least a portion of a container, an equipment, a system or a facility for holding, processing, packaging, storing, transporting, preparing, cooking or serving a meat item, a fruit item, a vegetable item, or a grain item. In other embodiments, the target is at least a portion of a container, an equipment, a system or a facility for holding, processing, packaging, storing, or transporting an animal carcass. In still other embodiments, the target is at least a portion of a container, an equipment, a system or a facility used in food processing, food service or health care industry. In yet other embodiments, the target is at least a portion of a fixed in-place process facility. An exemplary fixed in-place process facility can comprise a milk line dairy, a continuous brewing system, a pumpable food system or a beverage processing line.

The present methods can be used for treating a target that is at least a portion of a solid surface. In some embodiments, the solid surface is an inanimate solid surface. The inanimate solid surface can be contaminated by a biological fluid, e.g., a biological fluid comprising blood, other hazardous body fluid, or a mixture thereof. In other embodiments, the solid surface can be a contaminated surface. An exemplary contaminated surface can comprise the surface of food service wares or equipment.

The present methods require a certain minimal contact time of the compositions with the surface, liquid and/or product in need of treatment for occurrence of sufficient antimicrobial effect. The contact time can vary with concentration of the use compositions, method of applying the use compositions, temperature of the use compositions, pH of the use compositions, amount of the surface, liquid and/or product to be treated, amount of soil or substrates on/in the surface, liquid and/or product to be treated, or the like. The contact or exposure time can be about 15 seconds, at least about 15 seconds, about 30 seconds or greater than 30 seconds. In some embodiments, the exposure time is about 1 to 5 minutes. In other embodiments, the exposure time is at least about 10 minutes, 30 minutes, or 60 minutes. In other embodiments, the exposure time is a few minutes to hours. In other embodiments, the exposure time is a few hours to days.

The present methods can be conducted at any suitable temperature. In some embodiments, the present methods are conducted at a temperature ranging from about 0° C. to about 70° C., e.g., from about 0° C. to about 4° C. or 5° C., from about 5° C. to about 10° C., from about 11° C. to about 20° C., from about 21° C. to about 30° C., from about 31° C. to about 40° C., including at about 37° C., from about 41° C. to about 50° C., from about 51° C. to about 60° C., or from about 61° C. to about 85° C., or at increased temperatures there above suitable for a particular application of use.

The compositions employing preservative system according to the invention are suitable for antimicrobial efficacy against a broad spectrum of microorganisms, providing broad spectrum bactericidal and fungistatic activity. For example, the preservative systems of this invention provide broad spectrum activity against wide range of different types of microorganisms (including both aerobic and anaerobic microorganisms, gram positive and gram negative microorganisms), including bacteria, yeasts, molds, fungi, algae, and other problematic microorganisms.

The present methods can be used to achieve any suitable reduction of the microbial population in and/or on the target or the treated target composition. In some embodiments, the present methods can be used to reduce the microbial population in and/or on the target or the treated target composition by at least one $\log_{10}$. In other embodiments, the present methods can be used to reduce the microbial population in and/or on the target or the treated target composition by at least two $\log_{10}$. In still other embodiments, the present methods can be used to reduce the microbial population in and/or on the target or the treated target composition by at least three $\log_{10}$. In still other embodiments, the present methods can be used to reduce the microbial population in and/or on the target or the treated target composition by at least five $\log_{10}$. Without limiting the scope of invention, the numeric ranges are inclusive of the numbers defining the range and include each integer within the defined range.

The rinse aid can be dispensed as a concentrate or as a use solution. In general, it is expected that the concentrate will be diluted with water to provide first a sump solution for preservation as outlined according to the invention and thereafter for generating a use solution that is then supplied to the surface of a substrate. In some embodiments, the aqueous use solution may contain about 2,000 parts per million (ppm) or less active materials, or about 1,000 ppm or less active material, or in the range of about 10 ppm to about 500 ppm of active materials, or in the range of about 10 to about 300 ppm, or in the range of about 10 to 200 ppm.

The use solution can be applied to the substrate during a rinse application, for example, during a rinse cycle, for example, in a warewashing machine, a car wash application, institutional healthcare surface cleaning or the like. In some embodiments, formation of a use solution can occur from a rinse agent installed in a cleaning machine, for example onto a dish rack. The rinse agent can be diluted and dispensed from a dispenser mounted on or in the machine or from a separate dispenser that is mounted separately but cooperatively with the dish machine.

For example, in some embodiments, liquid rinse agents can be dispensed by incorporating compatible packaging containing the liquid material into a dispenser adapted to diluting the liquid with water to a final use concentration. Some examples of dispensers for the liquid rinse agent of the invention are DRYMASTER-P sold by Ecolab Inc., St. Paul, Minn.

In other example embodiments, solid products may be conveniently dispensed by inserting a solid material in a container or with no enclosure into a spray-type dispenser such as the volume SOL-ET controlled ECOTEMP Rinse Injection Cylinder system manufactured by Ecolab Inc., St. Paul, Minn. Such a dispenser cooperates with a washing machine in the rinse cycle. When demanded by the machine, the dispenser directs water onto the solid block of rinse agent which effectively dissolves a portion of the block creating a concentrated aqueous rinse solution which is then fed directly into the rinse water forming the aqueous rinse. The aqueous rinse is then contacted with the surfaces to affect a complete rinse. This dispenser and other similar dispensers are capable of controlling the effective concentration of the active portion in the aqueous rinse by measuring the volume of material dispensed, the actual concentration of the material in the rinse water (an electrolyte measured with an electrode) or by measuring the time of the spray on the cast block. In general, the concentration of active portion in the aqueous rinse is preferably the same as identified above for liquid rinse agents. Some other embodiments of spray-type dispenser are disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. An example of a particular product shape is shown in FIG. 9 of U.S. Pat. No. 6,258,765, which is incorporated herein by reference.

In some embodiments, it is believed that the rinse aid composition of the invention can be used in a high solids containing water environment in order to reduce the appearance of a visible film caused by the level of dissolved solids provided in the water. In general, high solids containing water is considered to be water having a total dissolved solids (TDS) content in excess of 200 ppm. In certain localities, the service water contains total dissolved solids content in excess of 400 ppm, and even in excess of 800 ppm. The applications where the presence of a visible film after washing a substrate is a particular problem includes the restaurant or warewashing industry, the car wash industry, the healthcare instrument reprocessing and cart washing sections, and the general cleaning of hard surfaces.

A use solution may be prepared from the concentrate by diluting the concentrate with water at a dilution ratio that provides an initial sump solution and thereafter a use solution having desired antimicrobial properties for a particular application of use. The water that is used to dilute the concentrate to form the use composition can be referred to as water of dilution or a diluent, and can vary from one location to another. The typical dilution factor from the sump solution to the use solution is between approximately 1 and approximately 10,000 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:2,000 concentrate to water.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

For various Examples set forth below, standards for assessing preservation achieved by the rinse aid composition employing the pyrithione preservation systems are outlined according to USP standards as well as additional standards as outlined herein. For USP bacteria there must be no less than 2.0 log reduction from the initial inoculated count at 14 days, and no increase from the 14 days' count at 28 days. A result of "no increase" is defined as not more than 0.5 log higher than previous value. For additional standards examined the preservation capability of a composition is evaluated over a predetermined time (as identified in the Example) and the inhibition or reduction of microbial growth is assessed, without the requirement for complete elimination of the entire microbial inoculum. Generally, a Fail refers to test sample results do not meet the above USP criteria; a Conditional Pass refers to test sample results that meet the USP criteria but have bacteria survivors after Day 7 of the test; and a Pass refers to test samples have no bacteria survivors after Day 7 of the test.

Example 1

In order to identify preservative systems for replacing Kathon CG-ICP (isothiazolinone blend) from solid rinse aid formulations, various potential preservatives were evaluated. A statistical analysis of potential preservatives were identified that do invoke hazardous use requirements relating to potential for allergic skin reactions upon contact. Evaluated preservatives included the following as shown in Table 10:

Kathon (CG-ICP, a 3:1 blend of 5-Chlor-2-methyl-4-isothiazolin-3-one and 2-Methyl-4-isothiazolin-3-one (CMIT/MIT))

Sorbic/Benzoic acid (GRAS acids)

Na Bisulfate (GRAS acid salt)

Monosodium Citrate/(Monosodium Citrate+Fumaric Acid) (GRAS acid salt)

Lonzabac (Bis(3-aminopropyl) dodecylamine)

Sodium Pyrithione

Preventol BM (Aqueous solution of 1,2-Benzisothiazolin-3-one and Methylisothiazolin-3-one (BIT/MIT))

Acusol 445 ND Base Polymer; potential preservative systems evaluated with and without the base polymer.

For performance reasons, the preservatives were tested with the 4500 MW polyacrylic acid polymer and 10% level of monosodium citrate or fumaric acid.

TABLE 10

| Run | Factor 1 A: Kathon % | Factor 2 B: Sorbic/ Benzole % | Factor 3 C: MC/ (MC + FA) 10% Level | Factor 4 D: Na Bisulfate % | Factor 5 E: Lonzabac % | Factor 6 F: Na Pyrithione % | Factor 7 G: Preventoal BM % | Factor 8 H: Polymer % | Base w/o Polymer % | pH |
|---|---|---|---|---|---|---|---|---|---|---|
| 1 | 0 | 1 | 100 | 1 | 0 | 3 | 0 | 0 | 85 | 4 |
| 2 | 0.00075 | 0.5 | 50 | 0.5 | 0.5 | 1.5 | 0.01 | 3 | 83.99 | 3.2 |
| 3 | 0 | 0 | 100 | 0 | 1 | 3 | 0.02 | 0 | 85.98 | 4.94 |
| 4 | 0.0015 | 0 | 100 | 0 | 0 | 3 | 0 | 6 | 81 | 4.41 |
| 5 | 0 | 1 | 0 | 0 | 1 | 3 | 0 | 6 | 79 | 3.43 |
| 6 | 0.0015 | 1 | 0 | 1 | 0 | 0 | 0 | 6 | 82 | 2.94 |
| 7 | 0.0015 | 1 | 100 | 1 | 1 | 3 | 0.02 | 6 | 77.98 | 4.82 |
| 8 | 0 | 0 | 0 | 0 | 0 | 0 | 0 | 0 | 90 | 3.18 |
| 9 | 0.0015 | 1 | 100 | 0 | 1 | 0 | 0 | 0 | 88 | 3.94 |
| 10 | 0.00075 | 0.5 | 50 | 0.5 | 0.5 | 1.5 | 0.01 | 3 | 83.99 | 3.22 |
| 11 | 0 | 1 | 100 | 0 | 0 | 0 | 0.02 | 6 | 82.98 | 4.36 |

TABLE 10-continued

| Run | Factor 1 A: Kathon % | Factor 2 B: Sorbic/ Benzole % | Factor 3 C: MC/ (MC + FA) 10% Level | Factor 4 D: Na Bisulfate % | Factor 5 E: Lonzabac % | Factor 6 F: Na Pyrithione % | Factor 7 G: Preventoal BM % | Factor 8 H: Polymer % | Base w/o Polymer % | pH |
|---|---|---|---|---|---|---|---|---|---|---|
| 12 | 0.0015 | 0 | 0 | 0 | 1 | 0 | 0.02 | 6 | 82.98 | 3.31 |
| 13 | 0 | 1 | 0 | 1 | 1 | 0 | 0.02 | 0 | 86.98 | 3.06 |
| 14 | 0.0015 | 0 | 100 | 1 | 0 | 0 | 0.02 | 0 | 88.98 | 3.79 |
| 15 | 0 | 0 | 0 | 1 | 0 | 3 | 0.02 | 6 | 79.98 | 2.71 |
| 16 | 0 | 0 | 100 | 1 | 1 | 0 | 0 | 6 | 82 | 4.84 |
| 17 | 0.0015 | 1 | 0 | 0 | 0 | 3 | 0.02 | 0 | 85.98 | 3.45 |
| 18 | 0.00075 | 0.5 | 50 | 0.5 | 0.5 | 1.5 | 0.01 | 3 | 83.99 | 3.27 |
| 19 | 0.0015 | 0 | 0 | 1 | 1 | 3 | 0 | 0 | 85 | 3.2 |

The preservatives were tested against a yeast and mold inoculum cocktail made up of equal parts of the organisms listed in an Sabourand agar (3 day incubation at 26° C.): Canidia *albicans* ATCC 10231, *Saccharomyces cerevisiae* ATCC 834, and *Aspergillus niger* ATCC 16404. The test temperature was ambient (20° C.–26° C.) and exposure times were 0, 7, 14, 28 and 35 days.

The preservatives were formulated at their upper concentration levels before triggering the use of personal protective equipment and measured fungi recovered and pH. An acidic solid rinse aid composition including 25-40% urea, 10-20% alcohol C10-C16 ethoxylate, 30-40% Pluronic 25R2 (reverse EO/PO block copolymer), 0-10% Acusol 445 ND, and 1-3% water was formulated to evaluate the potential preservative systems at sump solution concentrations <1% and <0.1%. As shown in FIG. 1, pyrithione had the greatest impact at reducing fungi in the samples (as shown in mean log fungi reduction) over 3 weeks in sump solution.

Example 2

Based on the formulations containing preservative system samples set forth in Example 1, the compositions were further evaluated for sump solution efficacy in preservative tests with yeast and mold on a 2% sump solution over 4 weeks. The yeast and mold inoculum are described in Example 1. For the various series of evaluations, simulated sump solutions (2%) were prepared to evaluate stability.

The yeast/mold inoculum: 5.8 log CFU/ml results are shown in Table 11 with assessment for USP efficacy. Only a fungi test was employed as the passing grades are indicative of expected success for the bacterium tests.

TABLE 11

| Run | Yeast/Mold (Weeks) 1 | 2 | 3 | 4 | Result |
|---|---|---|---|---|---|
| 1 | <1.0 | <1.0 | <1.0 | <1.0 | Pass |
| 2 | <1.0 | <1.0 | <1.0 | <1.0 | Pass |
| 3 | <1.0 | <1.0 | <1.0 | <1.0 | Pass |
| 4 | <1.0 | <1.0 | <1.0 | <1.0 | Pass |
| 5 | <1.0 | <1.0 | <1.0 | <1.0 | Pass |
| 6 | 4.6 | 4.2 | 3.4 | 3 | Conditional Pass |
| 7 | <1.0 | <1.0 | <1.0 | <1.0 | Pass |
| 8 | 6 | 6.1 | 6.2 | 6.1 | Conditional Pass |
| 9 | 3.6 | 2.9 | 2.8 | 2.6 | Conditional Pass |
| 10 | <1.0 | <1.0 | <1.0 | <1.0 | Pass |
| 11 | 5.6 | 5.6 | 5.6 | 5.5 | Conditional Pass |
| 12 | 5.6 | 6.3 | 6.2 | 6.5 | Conditional Pass |
| 13 | 1.6 | 1.3 | 1 | <1.0 | Conditional Pass |

TABLE 11-continued

| Run | Yeast/Mold (Weeks) 1 | 2 | 3 | 4 | Result |
|---|---|---|---|---|---|
| 14 | 5.9 | 6.6 | 5.7 | 4.9 | Conditional Pass |
| 15 | <1.0 | <1.0 | <1.0 | <1.0 | Pass |
| 16 | 6.3 | 6.4 | 6.9 | 6.6 | Conditional Pass |
| 17 | <1.0 | <1.0 | <1.0 | <1.0 | Pass |
| 18 | <1.0 | <1.0 | <1.0 | <1.0 | Pass |
| 19 | <1.0 | <1.0 | <1.0 | <1.0 | Pass |

The evaluation of formulations 1-19 in Examples 1 and 2 resulted in the initial discovery that the initially promising bis (3-aminopropyl) dodecylamine preservative candidate would precipitate out of solution in combination with the 4500 MW polyacrylic acid polymer under acidic conditions when the bis (3-aminopropyl) dodecylamine would be expected to be cationic in nature. As result of the initial testing the distinct candidate preservative systems in various combinations indicated that every sample that did not contain sodium pyrithione only received a conditional pass (yeast or mold survivors after day 7 of the test), while every sample that contained sodium pyrithione received a pass (no yeast or mold survivors after day 7 of the test).

Example 3

Additional testing was conducted to focus on GRAS acid for candidate preservative systems. Micro preservative data was obtained to assess the impact of acid formulations of the solid rinse aid compositions (e.g. Monosodium Citrate (MSC)) containing a preservative system on amount of preservative remaining over time. The evaluated preservative formulations employed in the rinse aid composition are shown above each including a base in the amount of 75-90%. The acidic solid rinse aid composition formulated with the preservative formulations of Table 12 included 25-40% urea, 10-20% alcohol C10-C16 ethoxylate, 30-40% Pluronic 25R2 (reverse EO/PO block copolymer), 0-10% Acusol 445 ND, and 1-3% water.

TABLE 12

| Run | Kathon | Kathon 1.15% CMIT/ 0.35% MIT | Sorbic | Benzoic | Monosodium Citrate | Citric Acid | Fumaric | Na Bisulfate | Lonzabac | 40% Pyrithione |
|---|---|---|---|---|---|---|---|---|---|---|
| P1 | 0 | 0 | 0 | 0 | 0 | 0 | 9.94 | 0 | 0.94 | 0 |
| P2 | 0 | 0 | 0.94 | 0.94 | 0 | 0 | 9.94 | 0 | 0.94 | 0 |
| P3 | 0 | 0 | 0.94 | 0.94 | 0 | 0 | 9.94 | 0.94 | 0.94 | 0 |
| P4 | 0 | 0 | 0 | 0 | 0 | 0 | 0 | 0 | 0.94 | 0 |
| P5 | 0 | 0 | 0 | 0 | 9.94 | 0 | 0 | 0 | 0 | 0 |
| P6 | 0 | 0 | 0.94 | 0.94 | 9.94 | 0 | 0 | 0 | 0 | 0 |
| P7 | 0 | 0 | 0 | 0 | 9.94 | 0 | 0 | 0 | 0 | 0 |
| P8 | 0 | 0 | 0.94 | 0.94 | 9.94 | 0 | 0 | 0 | 0 | 3.49 |

| Run | BENZISOTHIAZOLINONE (18.5%) | METHYLISOTHIAZOLINONE (9.9% active) | 2-n-octly-4-isothiazolin-3-one (45%) | Thymol | Amical 48 |
|---|---|---|---|---|---|
| P1 | 0 | 0 | 0 | 0 | 0 |
| P2 | 0 | 0 | 0 | 0 | 0 |
| P3 | 0 | 0 | 0 | 0 | 0 |
| P4 | 0 | 0 | 0 | 0 | 0 |
| P5 | 0.026 | 1.000 | 0.011 | 0 | 0 |
| P6 | 0 | 0 | 0 | 0 | 0.94 |
| P7 | 0 | 0 | 0 | 0.94 | 0 |
| P8 | 0 | 0 | 0 | 0 | 0 |

The bacteria inoculum was made up of equal parts of the organisms listed (incubated in tryptone glucose extract agar at 32° C. for 3 days):

*Staphylococcus aureus* ATCC 6538

*Escherichia coli* ATCC 11229

*Enterobacter aerogenes* ATCC 13048

*Burkholderia cepacia* ATCC 25416

*Pseudomonas aeruginosa* ATCC 15442

*Pseudomonas* field isolate NA

The yeast and mold inoculum was made up of equal parts of the organisms listed (incubated in sabourand agar at 26° C. for 3 days):

Canidia *albicans* ATCC 10231

*Saccharomyces cerevisiae* ATCC 834

*Aspergillus niger* ATCC 16404

The results are shown in Tables 13-15 for inoculum numbers (Log CFU/mL) employing the same preservation criteria as described above.

TABLE 13

| | Test System | | |
|---|---|---|---|
| | A | B | Average |
| Bacterial cocktail | 6.9 | 6.9 | 6.9 |
| Yeast and mold cocktail | 5.9 | 5.9 | 5.9 |

Table 13 shows the test systems were run in duplicate and two batches of inoculum were generated. The Inoculum Numbers (Log CFU/mL) are averaged.

TABLE 14

(Bacterial Counts (Log CFU/mL))

| Sample Number | Day 0 Sterility | Day 7 Survivors | Day 14 Survivors | Day 21 Survivors | Day 28 Survivors | Pass/ Fail |
|---|---|---|---|---|---|---|
| P1 | <1 | <1.0 | <1.0 | <1.0 | <1.0 | Pass |
| P2 | <1 | <1.0 | <1.0 | <1.0 | <1.0 | Pass |
| P3 | <1 | <1.0 | <1.0 | <1.0 | <1.0 | Pass |
| P4 | <1 | <1.0 | <1.0 | <1.0 | <1.0 | Pass |
| P5 | <1 | 2.1 | <1.0 | <1.0 | <1.0 | Pass |
| P6 | <1 | <1.0 | <1.0 | <1.0 | <1.0 | Pass |
| P7 | <1 | 7.2 | 6.7 | 6.9 | 5.7 | Fail |
| P8 | <1 | <1.0 | <1.0 | <1.0 | <1.0 | Pass |

TABLE 15

(Yeast and Mold Counts (Log CFU/mL))

| Sample Number | Day 0 Sterility | Day 7 Survivors | Day 14 Survivors | Day 21 Survivors | Day 28 Survivors | Pass/Fail |
|---|---|---|---|---|---|---|
| P1 | <1 | 6.0 | 5.8 | 5.8 | 5.8 | Conditional Pass |
| P2 | <1 | 1.9 | 1.0 | <1.0 | <1.0 | Conditional Pass |

TABLE 15-continued

| (Yeast and Mold Counts (Log CFU/mL)) | | | | | | |
|---|---|---|---|---|---|---|
| Sample Number | Day 0 Sterility | Day 7 Survivors | Day 14 Survivors | Day 21 Survivors | Day 28 Survivors | Pass/Fail |
| P3 | <1 | 1.6 | <1.0 | <1.0 | <1.0 | Pass |
| P4 | <1 | <1.0 | <1.0 | <1.0 | <1.0 | Pass |
| P5 | <1 | 6.0 | 5.7 | 5.7 | 6.2 | Conditional Pass |
| P6 | <1 | 4.6 | 4.1 | 4.2 | 3.9 | Conditional Pass |
| P7 | <1 | 5.6 | 5.1 | 5.6 | 6.0 | Conditional Pass |
| P8 | <1 | <1.0 | <1.0 | <1.0 | <1.0 | Pass |

The results indicate that acid formulations of the solid rinse aid compositions containing pyrithione result in higher levels of pyrithione remaining over time. The retained pyrithione preservative indicates the diluted solid sanitizing rinse aid composition upon dilution in a sump will retain sufficient preservation.

Example 5

Formulations of pyrithione preservatives were evaluated in existing solid rinse aid formulations for USP and commercial standards, modified to incorporate field isolate from a sump solution. The survival of both bacterial cocktail and fungal cocktails (as described in prior Example) were monitored over 28 days. Samples tested were prepared in 5 and 17 grain water (actual measurements of 7 and 18.5 grain water). The evaluated formulations are outlined in Tables 16A-D.

TABLE 16A

| Code | Formulation Highlights | Water |
|---|---|---|
| P9 | 1.40% Sodium Pyrithione | 7 gpg city |
| P10 | 1.40% Sodium Pyrithione | 18.5 gpg well |
| P11 | 0.70% Sodium Pyrithione | 7 gpg city |
| P12 | 0.70% Sodium Pyrithione | 18.5 gpg well |
| P13 | 1.05% Sodium Pyrithione | 7 gpg city |
| P14 | 1.05% Sodium Pyrithione | 18.5 gpg well |
| P16 | 1.4% Sodium Pyrithione | 7 gpg city |
| P17 | 1.4% Sodium Pyrithione | 18.5 gpg well |
| P18 | 1.4% Sodium Pyrithione | 7 gpg city |
| P19 | 1.4% Sodium Pyrithione | 18.5 gpg well |

TABLE 16B

| (P9-P14 formulations) | | | | | | |
|---|---|---|---|---|---|---|
| | Component solid formulations wt-% | | | | | |
| | P9 | P10 | P11 | P12 | P13 | P14 |
| Urea | 29 | 29 | 29.7 | 29.7 | 29.4 | 33.5 |
| C10-12 Alcohol 21 EO | 14.7 | 14.7 | 15 | 15 | 14.9 | 14.9 |
| Reverse EO PO Block Copolymer | 34.3 | 34.3 | 35 | 35 | 34.7 | 34.7 |
| Acrylic acid polymer | 6 | 6 | 6 | 6 | 6 | 6 |
| Sodium Pyrithione (40%) | 3.5 | 3.5 | 1.75 | 1.75 | 2.6 | 2.6 |
| Monosodium Citrate | 9.9 | 9.9 | 9.9 | 9.9 | 9.9 | 9.9 |
| Water | 2.4 | 2.4 | 2.4 | 2.4 | 2.4 | 2.4 |

TABLE 16C

| (P16-P17 formulations) | | |
|---|---|---|
| Component solid formulations wt-% | P16 | P17 |
| Sodium Xylene Sulfonate, 96% | 65.5 | 65.5 |
| Citric Acid anhydrous | 9.9 | 9.9 |
| C10-12 Alcohol 21 EO | 1.6 | 1.6 |
| Reverse EO PO block copolymer | 2.3 | 2.3 |
| Butoxy Capped Alcohol Ethoxylate | 4.4 | 4.4 |
| C12-16 Alcohol 7EO 5PO | 6.7 | 6.7 |
| Na4 HEDP 85% (~59% as acid) | 2.8 | 2.8 |
| Acrylic acid polymer | 6.1 | 6.1 |
| Sodium Pyrithione (40%) | 3.5 | 3.5 |

TABLE 16D

| (P18-P19 formulations) | | |
|---|---|---|
| Component solid formulations wt-% | P18 | P19 |
| C10-12 Alcohol 21 EO | 6.9 | 6.9 |
| Reverse EO PO block copolymer | 28.8 | 28.8 |
| Butoxy Capped Alcohol Ethoxylate | 16.8 | 16.8 |
| C12-16 Alcohol 7PO 5EO | 9.5 | 9.5 |
| Urea | 35.9 | 35.9 |
| Water | 0 | 0 |
| Sodium Pyrithione (40%) | 3.5 | 3.5 |

The bacteria inoculum was made up of equal parts of the organisms listed (incubated in tryptone glucose extract agar at 32° C. for 3 days):

*Staphylococcus aureus* ATCC 6538

*Escherichia coli* ATCC 11229

*Enterobacter aerogenes* ATCC 13048

*Burkholderia cepacia* ATCC 25416

*Pseudomonas aeruginosa* ATCC 15442

Isolate from commercial sump NA

The yeast and mold inoculum was made up of equal parts of the organisms listed (incubated in sabourand agar at 26° C. for 3 days):

Canidia *albicans* ATCC 10231

*Saccharomyces cerevisiae* ATCC 834

*Aspergillus niger* ATCC 16404

The results are shown in Tables 17-19 for inoculum numbers (Log CFU/mL) employing the same preservation criteria as described above.

TABLE 17

(Shown Inoculum Numbers (Log CFU/mL) averaged)

| | Test System | | |
|---|---|---|---|
| | A | B | Average |
| Bacterial cocktail | 6.6 | 6.6 | 6.6 |
| Yeast and mold cocktail | 5.7 | 5.8 | 5.75 |

TABLE 18

(Bacterial Counts (Log CFU/mL))

| Sample Number | Day 0 Sterility | Day 7 Survivors | Day 14 Survivors | Day 21 Survivors | Day 28 Survivors | Pass/ Fail |
|---|---|---|---|---|---|---|
| P9 | <1 | 1.6 | <1.0 | <1.0 | <1.0 | Pass |
| P10 | <1 | 3.2 | <1.0 | <1.0 | <1.0 | Pass |
| P11 | <1 | 2.8 | <1.0 | <1.0 | <1.0 | Pass |
| P12 | <1 | 2.5 | <1.0 | <1.0 | <1.0 | Pass |
| P13 | <1 | 5.1 | <1.0 | <1.0 | <1.0 | Pass |
| P14 | <1 | 1.3 | <1.0 | <1.0 | <1.0 | Pass |
| P15 | <1 | 1 | <1.0 | <1.0 | <1.0 | Pass |
| P16 | <1 | <1.0 | <1.0 | <1.0 | <1.0 | Pass |
| P17 | <1 | <1.0 | <1.0 | <1.0 | <1.0 | Pass |
| P18 | <1 | 6.1 | 5.8 | 5.6 | 5.6 | Fail |
| P19 | <1 | 6.1 | 5.8 | 6.6 | 6.6 | Fail |

TABLE 19

(Yeast and Mold Counts (Log CFU/mL))

| Sample Number | Day 0 Sterility | Day 7 Survivors | Day 14 Survivors | Day 21 Survivors | Day 28 Survivors | Pass/Fail |
|---|---|---|---|---|---|---|
| P9 | <1 | <1.0 | <1.0 | <1.0 | <1.0 | Pass |
| P10 | <1 | <1.0 | <1.0 | <1.0 | <1.0 | Pass |
| P11 | <1 | 1.5 | <1.0 | <1.0 | <1.0 | Pass |
| P12 | <1 | 3.7 | 1 | <1.0 | <1.0 | Conditional Pass |
| P13 | <1 | 1 | <1.0 | <1.0 | <1.0 | Pass |
| P14 | <1 | 1 | <1.0 | <1.0 | <1.0 | Pass |
| P15 | <1 | 2.8 | 2.5 | 2.5 | 2.4 | Conditional Pass |
| P16 | <1 | <1.0 | <1.0 | <1.0 | <1.0 | Pass |
| P17 | <1 | <1.0 | <1.0 | <1.0 | <1.0 | Pass |
| P18 | <1 | 5 | 3.7 | 3.4 | 3.1 | Conditional Pass |
| P19 | <1 | 5 | 3.7 | 3.4 | 3.1 | Conditional Pass |

Figure 2A:
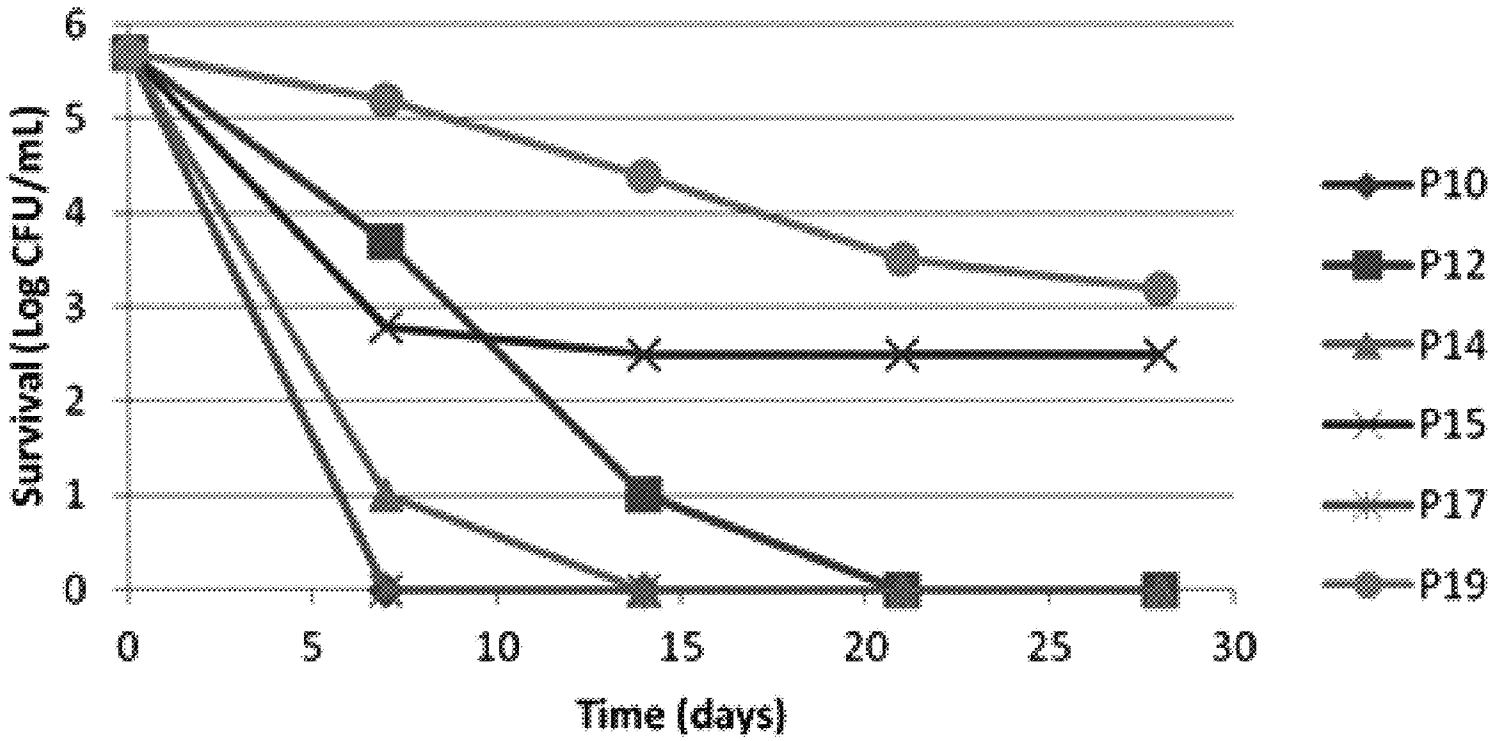
FIGS. 2A-B show antifungal test efficacy of evaluated rinse aid compositions containing preservative systems in 18.5 grain well water (shown in FIG. 2A) and 7 grain well water (shown in FIG. 2B) according to embodiments of the invention.
Figure 2B:
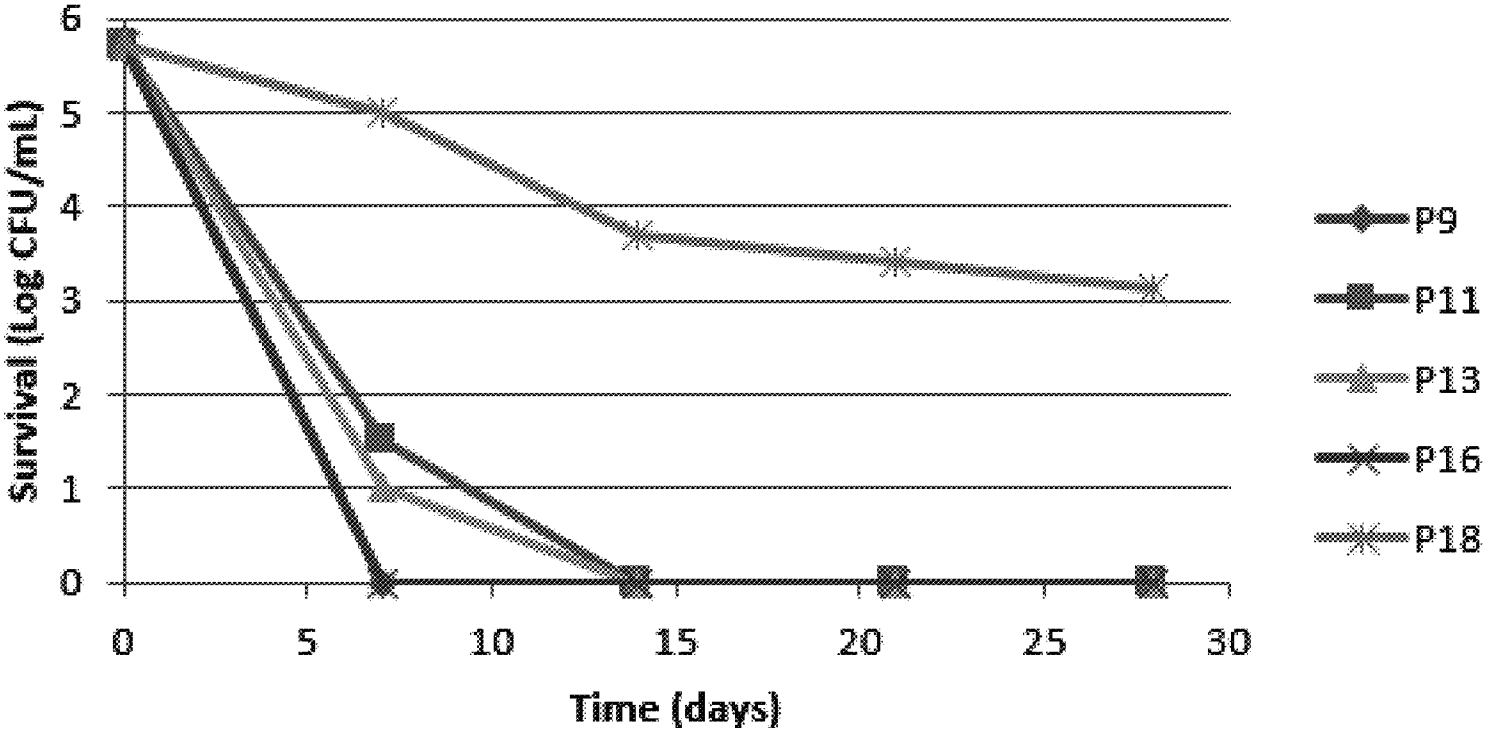
Figure 3A:
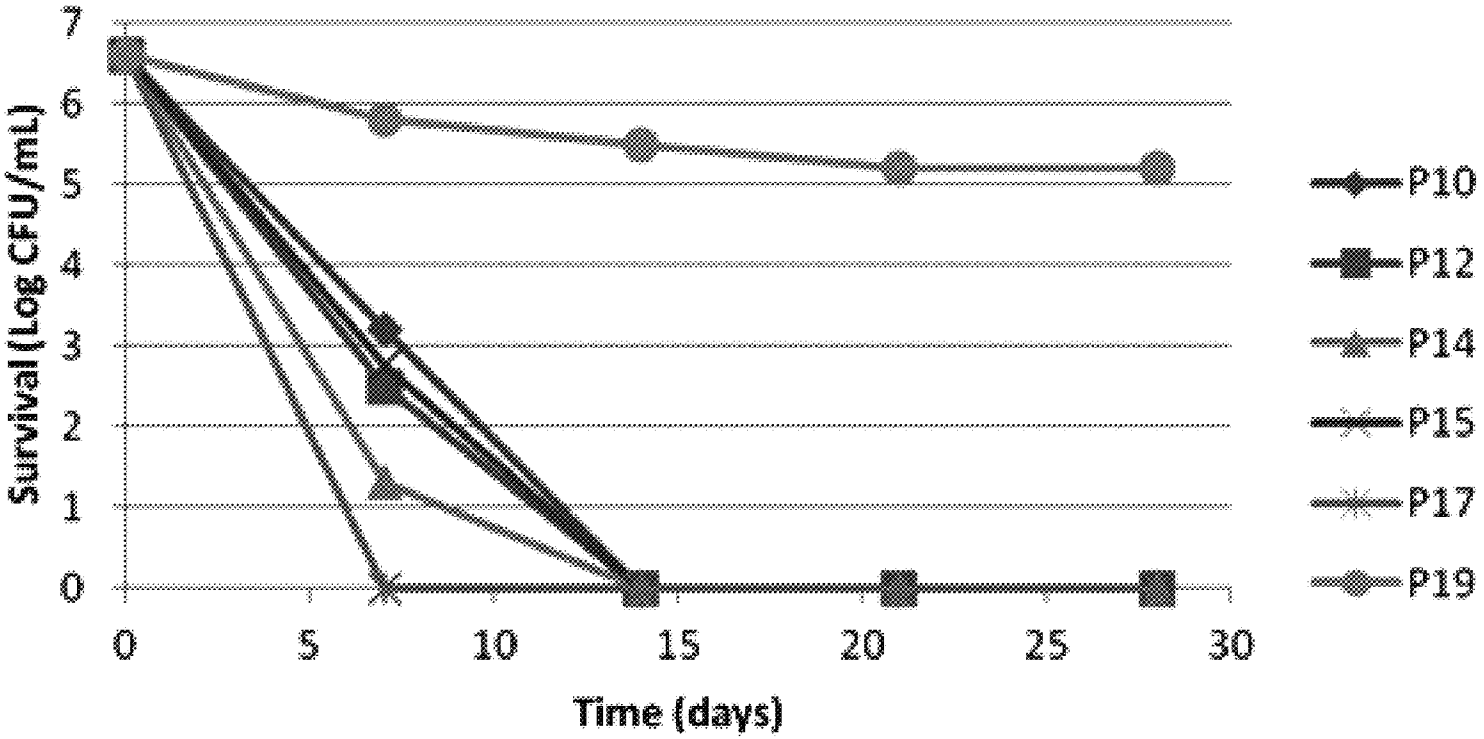
FIGS. 3A-B shows antimicrobial test efficacy of evaluated rinse aid compositions containing preservative systems in 18.5 well water (shown in FIG. 3A) and 7 grain well water (shown in FIG. 3B) according to embodiments of the invention.
Figure 3B:
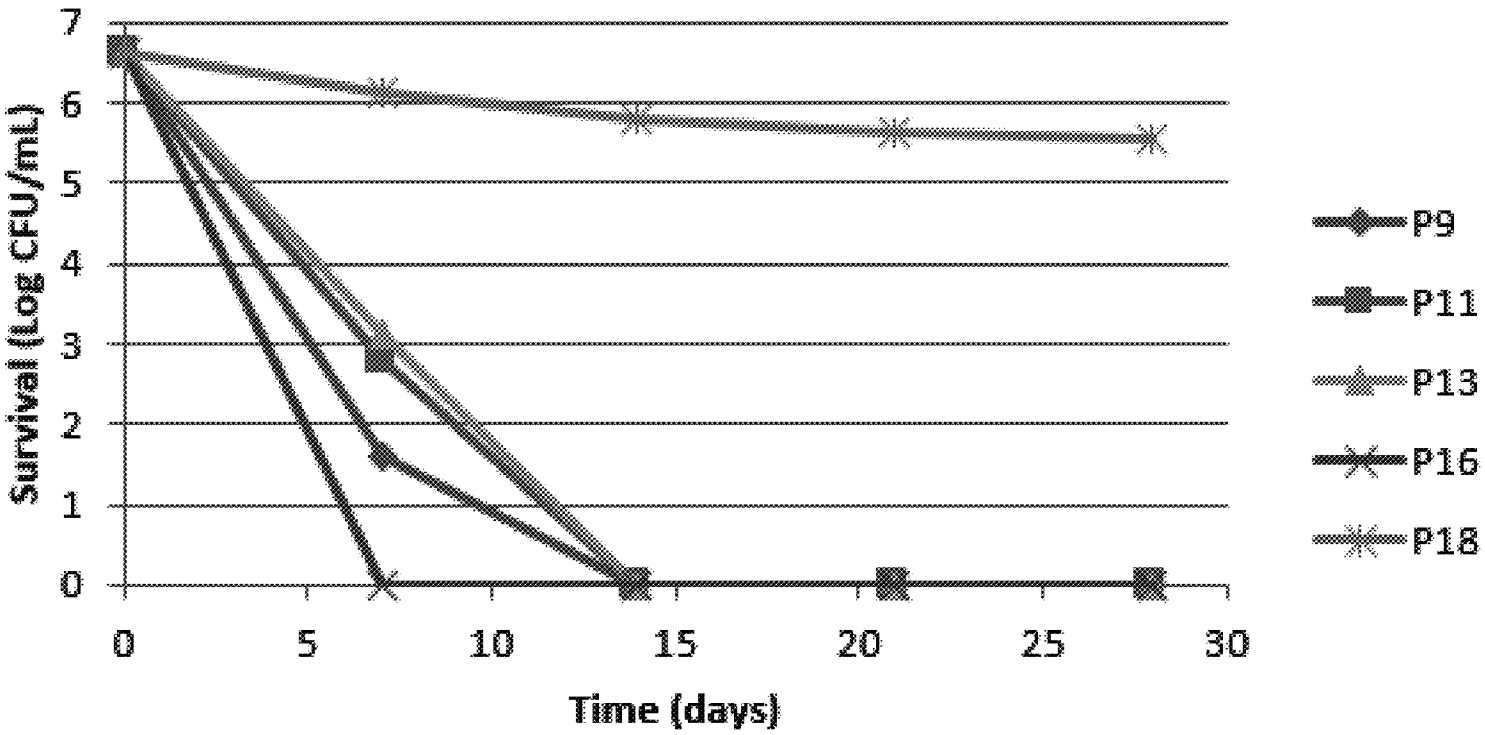

Further, FIGS. 2A-B show antifungal test efficacy of evaluated rinse aid compositions containing preservative systems in 18.5 grain (2A) and 7 grain (2B) well water, and FIGS. 3A-B shows antimicrobial test efficacy of evaluated rinse aid compositions containing preservative systems in 18.5 grain (3A) and 7 grain (3B) well water.

The results further demonstrated the impact of sodium pyrithione levels in different rinse aid systems with varying levels of acidity (approximately 2000 ppm citric acid, 2000 ppm monosodium citrate, and no acidulants). Surprisingly it was found that even at 140 ppm of sodium pyrithione with 2000 ppm monosodium citrate was much more effective at inhibiting microorganisms (especially bacteria), than 300 ppm of sodium pyrithione with no added acidity. It was also observed 140 ppm of sodium pyrithione with 2000 ppm monosodium citrate outperformed 200 ppm bis (3-amino-propyl) dodecylamine in hard water.

The results still further demonstrate the need for an acidic pH with the use of the pyrithione preservative system according to the invention. Namely a pH less than or equal to 7, preferably less than or equal to 6, or preferably less than or equal to 4.

Example 6

Additional evaluations of pyrithione preservative formulations were evaluated in existing solid rinse aid formulations. Standard solutions were prepared using the sodium salt of pyrithione, so the results are in term of the sodium salt. The theoretical number assumes the sodium salt and are calculated for the standard assay value (99.2%).

The evaluated formulations are outlined in Table 20.

TABLE 20

| Sample | % Pyrithione | % Pyrithione theoretical | % Recovery |
|---|---|---|---|
| SP1-Room Temp | 0 | 0 | NA |
| SP2-Room Temp | 1.29 | 1.34 | 96.2 |
| SP2-122° F. | 1.11 | 1.34 | 83.8 |
| SP7-Room Temp | 1.34 | 1.34 | 100 |
| SP7-122° F. | 1.26 | 1.34 | 94.0 |
| SP8-Room Temp | 0.86 | 1.20 | 71.7 |
| SP8-122° F. | 0.05 | 1.20 | 4.2 |
| SP9-Room Temp | 0.97 | 1.22 | 79.5 |
| SP9-122° F. | 0.77 | 1.22 | 63.1 |

TABLE 20-continued

| Sample | % Pyrithione | % Pyrithione theoretical | % Recovery |
|---|---|---|---|
| SP10-Room Temp | 1.10 | 1.45 | 75.9 |
| SP10-122° F. | 0.94 | 1.45 | 64.8 |

An observation from the results indicates that solutions containing the preservative system had a slight decrease in activity (estimated 3-4%) as they were not generated under conditions indicating use in a sump (i.e. freshly prepared standards), demonstrating a limitation on the stability in water of the sodium salt of pyrithione. The results show the dramatic loss in the SP8 at 122° F. demonstrate the sensitivity of the pyrithione preservative towards electrophiles such as sorbic acid.

Example 7

Still further evaluations of pyrithione preservative formulations were evaluated in existing solid rinse aid formulations to assess accelerated stability of the concentrated rinse aid compositions. The tests evaluate compositions aged 8 weeks at 50° C. to assess accelerated stability of compositions equivalent to at least 1 year of storage at room temperature (22° C.). The accelerated stability tests evaluated both measured performance of the preservative-containing rinse aid composition against microorganisms and by chemical analysis.

The evaluated preservative formulations employed in the rinse aid composition are shown in Table 21. The samples were aged for 8 weeks (at room temperature and 50° C.) before conducting the preservative test, with the exception of P070241 which was aged for 9 months at room temperature. The micro preservative testing was performed with 2% solutions of the solid to represent the low concentration for a dispenser according to embodiments of the invention.

TABLE 21

| | Kathon 1.15% CMIT/ 0.35% MIT | Monosodium Citrate | Citric Acid | 40% Pyrithione | Urea | Alcohol C10-16 Ethoxylated | Reverse EO PO block copolymer | Butoxy Capped Alcohol Ethoxylate | Fatty Alcohol with EO PO Adducts | SXS | Na4 HEDP 85% | Acrylic acid sodium salt polymer | Water |
|---|---|---|---|---|---|---|---|---|---|---|---|---|---|
| P070241.3 (Aged 9 months at RT) | 1.1 | 0 | 10 | 0.00 | 0.00 | 1.6 | 2.30 | 4.4 | 6.7 | 70.8 | 2.80 | 0.00 | 0.00 |
| P012151 | 1.4 | 10 | 0 | 0.00 | 30.6 | 14.7 | 34.30 | 0.00 | 0.00 | 0.00 | 0.00 | 6.10 | 2.760 |
| P021951 | 0.000 | 0 | 10 | 3.5 | 0.00 | 1.3 | 1.8 | 3.50 | 5.3 | 65.5 | 2.80 | 6.10 | 0.00 |
| P012851 | 0.000 | 9 | 0 | 3.6 | 27.3 | 15.6 | 36.4 | 0.00 | 0.00 | 0.00 | 0.00 | 5.45 | 2.500 |

The bacteria inoculum was made up of equal parts of the organisms listed (incubated in tryptone glucose extract agar at 32° C. for 3 days):

*Staphylococcus aureus* ATCC 6538
*Escherichia coli* ATCC 11229
*Enterobacter aerogenes* ATCC 13048
*Burkholderia cepacia* ATCC 25416
*Pseudomonas aeruginosa* ATCC 15442
Strenotrophomonas *maltophilia* NA The yeast and mold inoculum was made up of equal parts of the organisms listed (incubated in sabourand agar at 26° C. for 3 days):

Canidia *albicans* ATCC 10231
*Saccharomyces cerevisiae* ATCC 834
*Aspergillus niger* ATCC 16404

The results are shown in Tables 22-24 for inoculum numbers (Log CFU/mL) employing the same preservation criteria as described above.

TABLE 22

(Shown Inoculum Numbers (Log CFU/mL) averaged)

| | Test System | | |
|---|---|---|---|
| | A | B | Average |
| Bacterial cocktail | 7.1 | 7.0 | 7.05 |
| Yeast and mold cocktail | 6.5 | 6.7 | 6.60 |

TABLE 23

(Bacterial Counts (Log CFU/mL))

| | Day 0 Sterility | Day 7 Survivors | Day 14 Survivors | Day 21 Survivors | Day 28 Survivors | Pass/Fail |
|---|---|---|---|---|---|---|
| SP 10 Pyrithione - 8 weeks 50 C. (pH 5.59) | <1 | <1.0 | <1.0 | <1.0 | <1.0 | Pass |
| SP 10 Pyrithione - 10 Week RT (pH 5.29) | <1 | <1.0 | <1.0 | <1.0 | <1.0 | Pass |
| Kathon - 8 week 50 C. (pH 5.28) | <1 | <1.0 | <1.0 | <1.0 | <1.0 | Pass |

TABLE 23-continued

| (Bacterial Counts (Log CFU/mL)) | | | | | | |
|---|---|---|---|---|---|---|
| | Day 0 Sterility | Day 7 Survivors | Day 14 Survivors | Day 21 Survivors | Day 28 Survivors | Pass/Fail |
| Kathon - 11 week RT (pH 5.24) | <1 | <1.0 | <1.0 | <1.0 | <1.0 | Pass |
| SP 3 Pyrithione - 6 week 50 C. (pH 4.27) | <1 | <1.0 | <1.0 | <1.0 | <1.0 | Pass |
| SP 3 Pyrithione - 7 week RT (pH 4.27) | <1 | <1.0 | <1.0 | <1.0 | <1.0 | Pass |
| Kathon - 9 month RT (pH 3.42) | <1 | <1.0 | <1.0 | <1.0 | <1.0 | Pass |

TABLE 24

| (Yeast and Mold Counts (Log CFU/mL)) | | | | | | |
|---|---|---|---|---|---|---|
| | Day 0 Sterility | Day 7 Survivors | Day 14 Survivors | Day 21 Survivors | Day 28 Survivors | Pass/Fail |
| SP 10 Pyrithione - 8 weeks 50 C. (pH 5.59) | <1 | 5.3 | 4.6 | 3.6 | 2.2 | Conditional Pass |
| SP 10 Pyrithione - 10 Week RT (pH 5.29) | <1 | 2.6 | <1.0 | <1.0 | <1.0 | Pass |
| Kathon - 8 week 50 C. (pH 5.28) | <1 | 4.5 | 3.7 | 2.9 | 2.3 | Conditional Pass |
| Kathon - 11 week RT (pH 5.24) | <1 | 3.8 | 2.4 | <1.0 | <1.0 | Conditional Pass |
| SP 3 Pyrithione - 6 week 50 C. (pH 4.27) | <1 | 1.3 | <1.0 | <1.0 | <1.0 | Pass |
| SP 3 Pyrithione - 7 week RT (pH 4.27) | <1 | <1.0 | <1.0 | <1.0 | <1.0 | Pass |
| Kathon - 9 month RT (pH 3.42) | <1 | 4.6 | 3.6 | 2.6 | 2.1 | Conditional Pass |

As shown, the results indicate the pyrithione preservative systems of the present invention provide at least substantially similar preservation efficacy after accelerated stability testing. The data show the pyrithione preservative systems provide antimicrobial efficacy for at least 1 year after storage at room temperature (22° C.).

In addition to the stability testing using antimicrobial efficacy, the accelerated stability tests further evaluated chemical analysis of the systems. The levels of remaining pyrithione were measured and shown in Table 25.

TABLE 25

| Sample | Kathon (2-methyl) | Kathon (5-chloro) | Sodium pyrithione |
|---|---|---|---|
| 1.11% Kathon | Undetermined | 82 ppm | |
| 1.39% Kathon 50 C. 8 weeks | 54 ppm | 130 ppm | |

TABLE 25-continued

| Sample | Kathon (2-methyl) | Kathon (5-chloro) | Sodium pyrithione |
|---|---|---|---|
| 1.39% Kathon | 53 ppm | 140 ppm | |
| SP3 RT 8 weeks | | | 0.902% |
| SP3 50 C. 8 weeks | | | 0.241% |
| SP10 RT 8 weeks | | | 1.09% |
| SP10 50 C. 8 weeks | | | 0.544% |

Despite significant degradation of the levels of sodium pyrithione during accelerated stability testing, the measured performance was not impacted (as shown above in Tables 23-25). Without being limited according to a particular mechanism, the sodium pyrithione preservative system resulted in maintained concentration of related compounds which are active antimicrobially, including for example, 2,2'-Dithiobis(pyridine-N-oxide).

Example 8

Still further evaluations of pyrithione preservative formulations were evaluated in existing solid rinse aid formulations. The evaluated formulations are shown in Table 26.

TABLE 26

| | Monosodium Citrate | Citric Acid | 40% Pyrithione | Urea | Alcohol C10-16 Ethoxylated | Reverse EO PO block copolymer | Butoxy Capped Alcohol Ethoxylate | Fatty Alcohol with EO PO Adducts | SXS | Na4 HEDP 85% | Acrylic acid polymer | Water |
|---|---|---|---|---|---|---|---|---|---|---|---|---|
| PL20 | 0 | 0 | 6.98 | 34.09 | 6.52 | 27.38 | 15.95 | 9.02 | 0.00 | 0.00 | 0.00 | 0.00 |
| PL21 | 5 | 0 | 3.75 | 33.44 | 6.40 | 26.86 | 15.65 | 8.85 | 0.00 | 0.00 | 0.00 | 0.00 |
| PL22 | 10 | 0 | 3.75 | 31.60 | 6.05 | 25.39 | 14.79 | 8.36 | 0.00 | 0.00 | 0.00 | 0.00 |
| PL23 | 5 | 0 | 3.75 | 32.52 | 6.22 | 26.12 | 15.22 | 8.61 | 0.00 | 0.00 | 0.00 | 0.00 |
| PL24 | 10 | 0 | 3.75 | 29.37 | 5.62 | 23.59 | 13.74 | 7.77 | 0.00 | 0.00 | 0.00 | 6.10 |
| P25 | 0 | 0.795 | 1.88 | 0.00 | 1.66 | 2.30 | 4.38 | 6.68 | 65.45 | 2.80 | 6.10 | 7.88 |
| P26 | 0 | 0.795 | 2.81 | 0.00 | 1.66 | 2.30 | 4.38 | 6.68 | 65.45 | 2.80 | 6.10 | 6.94 |

The bacteria inoculum was made up of equal parts of the organisms listed (incubated in tryptone glucose extract agar at 32° C. for 3 days):

*Staphylococcus aureus* ATCC 6538

*Escherichia coli* ATCC 11229

*Enterobacter aerogenes* ATCC 13048

*Burkholderia cepacia* ATCC 25416

*Pseudomonas aeruginosa* ATCC 15442

The yeast and mold inoculum was made up of equal parts of the organisms listed (incubated in sabourand agar at 26° C. for 3 days):

Canidia *albicans* ATCC 10231

*Saccharomyces cerevisiae* ATCC 834

*Aspergillus niger* ATCC 16404

The results are shown in Tables 27-29 for inoculum numbers (Log CFU/mL) employing the same preservation criteria as described above.

TABLE 27

(Shown Inoculum Numbers (Log CFU/mL) averaged)

| | Test System | | |
|---|---|---|---|
| | A | B | Average |
| Bacterial cocktail | 6.8 | 6.8 | 6.8 |
| Yeast and mold cocktail | 5.9 | 5.9 | 5.8 |

TABLE 28

(Bacterial Counts (Log CFU/mL))

| Sample Number | Day 0 Sterility | Day 7 Survivors | Day 14 Survivors | Day 21 Survivors | Day 28 Survivors | Pass/Fail |
|---|---|---|---|---|---|---|
| P20 | <1 | 5.2 | 4.8 | 4.9 | 4.6 | Conditional Pass |
| P21 | <1 | <1.0 | <1.0 | <1.0 | <1.0 | Pass |
| P22 | <1 | <1.0 | <1.0 | <1.0 | <1.0 | Pass |
| P23 | <1 | <1.0 | <1.0 | <1.0 | <1.0 | Pass |
| P24 | <1 | <1.0 | <1.0 | <1.0 | <1.0 | Pass |
| P25 | <1 | 5.9 | 5.6 | — | — | Fail |
| P26 | <1 | 5.6 | 5.3 | — | — | Fail |

TABLE 29

(Yeast and Mold Counts (Log CFU/mL))

| Sample Number | Day 0 Sterility | Day 7 Survivors | Day 14 Survivors | Day 21 Survivors | Day 28 Survivors | Pass/Fail |
|---|---|---|---|---|---|---|
| P20 | <1 | 5.9 | 5.4 | 4.8 | 4.6 | Conditional Pass |
| P21 | <1 | <1.0 | <1.0 | <1.0 | <1.0 | Pass |
| P22 | <1 | <1.0 | <1.0 | <1.0 | <1.0 | Pass |
| P23 | <1 | <1.0 | <1.0 | <1.0 | <1.0 | Pass |
| P24 | <1 | <1.0 | <1.0 | <1.0 | <1.0 | Pass |
| P25 | <1 | 5.9 | 5.6 | — | — | Discontinued |
| P26 | <1 | 6.0 | 5.5 | — | — | Discontinued |

Example 9

Preservative systems according to the invention at varying pH sump solutions were evaluated based on the inclusion of the acidulant monosodium citrate (or exclusion of monosodium citrate) as outlined below:

Blocks were stored at room temperature or 50 C with and without monosodium citrate at pH of 5.2 and 8.3. The bacteria inoculum was made up of equal parts of the organisms listed (incubated in tryptone glucose extract agar at 32° C. for 3 days):

*Staphylococcus aureus* ATCC 6538
*Escherichia coli* ATCC 11229
*Enterobacter aerogenes* ATCC 13048
*Burkholderia cepacia* ATCC 25416
*Pseudomonas aeruginosa* ATCC 15442
*Stenotrophomonas* field isolate NA The yeast and mold inoculum was made up of equal parts of the organisms listed (incubated in sabourand agar at 26° C. for 3 days):

Canidia *albicans* ATCC 10231
*Saccharomyces cerevisiae* ATCC 834
*Aspergillus niger* ATCC 16404

The results are shown in Tables 30-32 for inoculum numbers (Log CFU/mL) employing the same preservation criteria as described above.

TABLE 30

(Shown Inoculum Numbers (Log CFU/mL) averaged)

| | Test System | | |
|---|---|---|---|
| | A | B | Average |
| Bacterial cocktail | 6.8 | 6.8 | 6.8 |
| Yeast and mold cocktail | 5.9 | 5.9 | 5.8 |

TABLE 31

(Bacterial Counts (Log CFU/mL))

| | Day 0 Sterility | Day 7 Survivors | Day 14 Survivors | Day 21 Survivors | Day 28 Survivors | Pass/Fail |
|---|---|---|---|---|---|---|
| SP D - 2 weeks 122 F. | <1 | <1.0 | <1.0 | <1.0 | <1.0 | Pass |
| SP 7 - RT | <1 | 6.0 | 6.1 | 5.9 | 6.1 | Fail |
| SP 7 - 2 weeks 122 F. | <1 | 6.5 | 6.5 | 6.3 | 5.8 | Fail |
| SP D - RT (pH 5.42) | <1 | <1.0 | <1.0 | <1.0 | <1.0 | Pass |

TABLE 32

(Yeast and Mold Counts (Log CFU/mL))

| | Day 0 Sterility | Day 7 Survivors | Day 14 Survivors | Day 21 Survivors | Day 28 Survivors | Pass/Fail |
|---|---|---|---|---|---|---|
| SP D - 2 weeks 122 F. | <1 | <1.0 | <1.0 | <1.0 | <1.0 | Pass |
| SP 7 - RT | <1 | 5.8 | 4.8 | 4.5 | 4.1 | Conditional Pass |
| SP 7 - 2 weeks 122 F. | <1 | 5.9 | 4.9 | 3.7 | 2.6 | Conditional Pass |
| SP D - RT (pH 5.42) | <1 | <1.0 | <1.0 | <1.0 | <1.0 | Pass |

The results demonstrate the compositions having the monosodium citrate in the formulation result in the passing preservation of the sump solutions containing sodium pyrithione at both temperatures evaluated.

Example 10

Solid rinse aid compositions were evaluated using a Small Extruder Experiment to assess physical stability through observations of the extruded solids. Formulations shown in Table 33 were evaluated for physical stability observations which are further documented therein.

TABLE 33

| | control | high pyrithione only | high pyrithione + Acrylic acid polymer | s/b/msc/ pyrithione | pyrithione/ Acrylic acid polymer | pyrithione/ Acrylic acid polymer | pyrithione/ Acrylic acid polymer – higher surf conc | s/b/msc/ pyrithione + Acrylic acid polymer | pyrithione/ Acrylic acid polymer/ MSC | pyrithione/ Acrylic acid sodium salt polymer/ MSC |
|---|---|---|---|---|---|---|---|---|---|---|
| Urea | 36.00 | 36.00 | 30.00 | 34.00 | 33.66 | 30.93 | 30.00 | 26.79 | 27.27 | 27.27 |
| Novel 1012-II GB | 18.32 | 17.48 | 17.48 | 14.46 | 16.50 | 17.18 | 17.48 | 15.61 | 15.89 | 15.58 |
| Reverse EO PO Block Copolymer | 42.74 | 40.78 | 40.78 | 33.74 | 38.48 | 40.07 | 40.78 | 36.41 | 37.07 | 36.36 |
| Water | 2.94 | 2.31 | 2.31 | 2.32 | 2.18 | 2.27 | 2.31 | 2.06 | 2.10 | 2.50 |
| 40% pyrithione | 0.00 | 3.35 | 3.35 | 3.36 | 3.16 | 3.29 | 3.35 | 2.99 | 3.05 | 3.62 |
| Acrylic acid polymer | 0.00 | 0.00 | 6.00 | 0.00 | 5.94 | 6.19 | 6.00 | 5.36 | 5.45 | 5.45 |
| monosodium citrate | 0.00 | 0.00 | 0.00 | 10.10 | 0.00 | 0.00 | 0.00 | 9.02 | 9.09 | 9.09 |
| benzoic acid | 0.00 | 0.00 | 0.00 | 0.95 | 0.00 | 0.00 | 0.00 | 0.85 | 0.00 | 0.00 |
| sorbic acid | 0.00 | 0.00 | 0.00 | 0.95 | 0.00 | 0.00 | 0.00 | 0.85 | 0.00 | 0.00 |
| Total | 100 | 100 | 100 | 100 | 100 | 100 | 100 | 100 | 100 | 100 |
| Observations | hard solid, some peeling | very hard solid, peeling | N/A | Hard solid in chunks | crumbling | holding shape but has voids | hard solid | N/A | slight peeling | no significant change from SP 9 |
| Theoretical % Active pyrithione | 0.00 | 1.44 | 1.44 | 1.45 | 1.36 | 1.42 | 1.44 | 1.29 | 1.31 | 1.56 |
| 5 day stability | no discoloration or cracking | cracking, discoloration at 122 F. | equivalent to SP 7 | N/A | N/A | N/A | cracking, discoloration at 122 F., some cracking at RT | cracking, discoloration at 122 F., some cracking at RT | cracking, discoloration at 122 F. | cracking, discoloration at 122 F. |

As shown in Table 33 the extruded compositions employing the pyrithione preservative system were evalulated at multiple set points: including 5 day stability assessment point (122° F.). Desired extruded compositions were not "mushy" or soft, nor did they have cracking. The evaluation took place at 122° F. to demonstrate extended stability at room temperature. As set forth according to the invention, the physically and chemically stable concentrated rinse aid compositions are unexpectedly achieved using the pyrithione preservative systems which provide adequate inhibition of microbial growth in an intermediate use dilution.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A solid rinse aid composition comprising:

a) from about 0.05 wt-% to about 20 wt-% of a pyrithione preservative;

b) from about 5 wt-% to about 80 wt-% of hardening agent comprising a solid acid;

c) two or more nonionic surfactants comprising one or more alcohol alkoxylates having the formula R—O—$(CH_2CH_2O)_n$—H, wherein R is a ($C_1$-$C_{12}$) alkyl group and n is an integer in the range of 1 to 100, and an ethylene oxide-propylene oxide (EO/PO) copolymer; and d) additional functional ingredients, wherein the composition is a solid concentrate, and the solid concentrate generates a stable and aqueous use solution having a neutral to acidic pH.

2. The rinse aid composition of claim 1, wherein an additional hardening agent or the additional functional ingredients comprise short chain alkyl benzene and/or alkyl naphthalene sulfonates.

3. The rinse aid composition of claim 2, wherein the short chain alkyl benzene and/or alkyl naphthalene sulfonates are present in an amount of from about 50 wt-% to about 80 wt-% and comprises: sodium xylene sulfonate, sodium toluene sulfonate, sodium cumene sulfonate, potassium toluene sulfonate, ammonium xylene sulfonate, calcium xylene sulfonate, sodium alkyl naphthalene sulfonate, sodium butyl_naphthalene sulfonate or a combination thereof.

4. The rinse aid composition of claim 1, wherein the hardening agent further comprises urea, sodium xylene sulfonate, sodium acetate, sodium sulfate, sodium carbonate, sodium tripoly phosphate, polyethylene glycol or a combination thereof.

5. The rinse aid composition of claim 1, wherein the solid acid is citric acid or a monovalent citrate salt.

6. The rinse aid composition of claim 1, wherein the solid rinse aid composition is a tablet, a pressed solid, a cast solid, or an extruded solid.

7. The rinse aid composition of claim 1, wherein said nonionic surfactants are present in an amount of from about 5 wt-% to about 50 wt-%.

8. The rinse aid composition of claim 1, wherein the alcohol alkoxylates are a combination of two or more alcohol alkoxylates having the formula of R—O—$(CH_2CH_2O)_n$—H wherein R is a ($C_1$-$C_{12}$) alkyl group and n is an integer in the range of 1 to 50.

9. The rinse aid composition of claim 1, wherein the ethylene oxide-propylene oxide copolymer has a single hydroxyl functional group per molecule according to the following structure Alkyl-(EO)m-(PO)n-POH, wherein m is an integer in the range from 1 to 20 and n is an integer in the range from 1 to 20.

10. The rinse aid composition of claim 1, wherein the ratio of the EO/PO copolymer to alcohol ethoxylate(s) is from about 1.5:1 to about 10:1.

11. The rinse aid composition of claim 1, wherein the nonionic surfactants comprises from about 0.5 wt-% to about 75 wt-% of the solid concentrate; and wherein the additional functional ingredients comprises from about 0.1 wt-% to about 50 wt-% of the solid concentrate, and wherein the additional functional ingredients are one or more of defoaming agents, additional surfactants, anti-redeposition agents, bleaching agents, solubility modifiers, dispersants, additional rinse aids, an anti-microbial agent, antiredeposition agents, metal protecting agents and/or etch protection, stabilizing agents, corrosion inhibitors, sequestrants and/or chelating agents, threshold inhibitors, enzymes, humectants, pH modifiers, fragrances and/or dyes, rheology modifiers or thickeners, buffers, and solvents.

12. The rinse aid composition of claim 11, wherein the additional functional ingredient is a polycarboxylate and comprises from about 0.1 wt-% to about 30 wt-% of the solid concentrate composition.

13. A method of making a solid rinse aid composition comprising;

providing solid ingredients of the composition of claim 1 and mixing the solid ingredients into a solid mixture;

allowing said solid mixture to set; and thereafter mixing in liquid ingredients of the composition of claim 1 with said solid mixture to form a rinse aid mixture;

forming a solid concentrate with the rinse aid mixture, wherein the solid concentrate can generate a stable and aqueous use solution having an acidic pH from about 0-7.

14. The method of claim 13, wherein said forming a solid concentrate is by pressing, extrusion or casting.

15. A method of rinsing comprising:

providing the solid rinse aid composition according to claim 1;

contacting the solid rinse aid composition with water to form a sump solution having a pH from about 0-7 and having anti-microbial efficacy, wherein the pyrithione preservative is in the sump solution from about 100 ppm to 500 ppm; and generating a use solution by diluting the sump solution with water and applying the use solution to a surface.

16. The method of claim 15, wherein the sump solution has a pH from about 2.5-5.5.

17. The method of claim 15, wherein said use solution comprises 2,000 ppm or less active materials.

18. The method of claim 15, wherein said use solution upon dilution of the sump solution has a pH from about 1 to about 9.

19. The method of claim 15, wherein said contacting is by directing water onto a solid block of the solid rinse aid composition, and wherein said surface is a hard surface comprising metal, glass, plastic, ceramic or tile.

20. The method of claim 15, wherein the concentrate composition is diluted from about 0.01% weight/volume to about 0.2% weight/volume with a diluent, and wherein the sump solution is from 1% to 20% of the solid rinse aid composition, and wherein the pyrithione preservative is in the sump solution from about 150 ppm to 300 ppm.

21. The method of claim 15, wherein the surface is spot-free and film-free upon contacting with the concentrated composition.

22. The method of claim 15, wherein the sump solution retains preservative efficacy for at least 4 weeks and wherein the solid rinse aid composition has a shelf-stability of at least one year at room temperature.

* * * * *